US007681993B2

(12) United States Patent
Ono et al.

(10) Patent No.: US 7,681,993 B2
(45) Date of Patent: Mar. 23, 2010

(54) CIRCUIT BOARD FOR INK JET HEAD, METHOD OF MANUFACTURING THE SAME, AND INK JET HEAD USING THE SAME

(75) Inventors: Kenji Ono, Tokyo (JP); Teruo Ozaki, Yokohama (JP); Toshiyasu Sakai, Yokohama (JP); Ichiro Saito, Yokohama (JP); Satoshi Ibe, Yokohama (JP); Sakai Yokoyama, Kawasaki (JP); Kazuaki Shibata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 11/203,129

(22) Filed: Aug. 15, 2005

(65) Prior Publication Data

US 2006/0033780 A1 Feb. 16, 2006

(30) Foreign Application Priority Data

Aug. 16, 2004 (JP) ..... 2004-236604

(51) Int. Cl.
*B41J 2/05* (2006.01)

(52) U.S. Cl. ..... 347/63; 347/64; 347/65; 347/58

(58) Field of Classification Search ..... 347/58, 347/63, 64, 65, 62; 216/27
See application file for complete search history.

(56) References Cited

U.S. PATENT DOCUMENTS 4,532,530 A * 7/1985 Hawkins ..... 347/62
4,686,544 A * 8/1987 Ikeda et al. ..... 347/64
4,723,129 A 2/1988 Endo et al. ..... 346/1.1
4,740,796 A 4/1988 Endo et al. ..... 346/1.1
4,862,197 A 8/1989 Stoffel
4,951,063 A * 8/1990 Hawkins et al. ..... 347/62

(Continued)

FOREIGN PATENT DOCUMENTS

EP 0 344 809 A 12/1989

(Continued)

OTHER PUBLICATIONS

Japanese Office Action dated Mar. 16, 2007, issued in corresponding Japanese patent application No. 2004-236604, with English-language translation.

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

An ink jet head circuit board is provided which has heaters to generate thermal energy for ejecting ink as they are energized. This circuit board is so constructed as to reduce wire resistances for the heaters while at the same time preventing an increase in the size of the board and realizing a high-density integration of the heaters required for high resolution printing. This construction is made possible by forming electrode wires of first and second electrode wire layers to reduce an area that the wire patterns for the heater occupy on the circuit board. In reducing the effective thickness of protective insulation layer formed on the heater to prevent a possible degradation of thermal efficiency, one of the protective insulation layers over the electrode wires is removed from the heater, depending on the thickness of the electrode wires.

3 Claims, 29 Drawing Sheets

U.S. PATENT DOCUMENTS

| | | | | | |
|---|---|---|---|---|---|
| 5,081,474 | A | | 1/1992 | Shibata et al. | |
| 5,257,042 | A | * | 10/1993 | Buhler | 347/64 |
| 5,479,197 | A | | 12/1995 | Fujikawa et al. | |
| 5,491,505 | A | | 2/1996 | Suzuki et al. | |
| 5,660,739 | A | | 8/1997 | Ozaki et al. | 216/27 |
| 6,056,391 | A | * | 5/2000 | Kasamoto et al. | 347/58 |
| 6,293,654 | B1 | * | 9/2001 | Pidwerbecki | 347/64 |
| 6,315,853 | B1 | | 11/2001 | Kubota et al. | |
| 6,402,302 | B1 | * | 6/2002 | Ozaki et al. | 347/65 |
| 6,443,563 | B1 | | 9/2002 | Saito et al. | |
| 6,450,617 | B1 | | 9/2002 | Kitani et al. | |
| 6,474,769 | B1 | | 11/2002 | Imanaka et al. | |
| 6,513,911 | B1 | | 2/2003 | Ozaki et al. | |
| 6,540,330 | B1 | | 4/2003 | Kubota et al. | |
| 6,578,951 | B2 | | 6/2003 | Ozaki et al. | |
| 6,609,783 | B1 | | 8/2003 | Koyama et al. | |
| 6,688,729 | B1 | | 2/2004 | Imanaka et al. | |
| 7,025,894 | B2 | * | 4/2006 | Hess et al. | 216/27 |
| 2003/0071877 | A1 | * | 4/2003 | Hess | 347/64 |
| 2003/0210302 | A1 | * | 11/2003 | Keefe et al. | 347/63 |
| 2005/0248623 | A1 | | 11/2005 | Komuro et al. | |
| 2006/0033782 | A1 | | 2/2006 | Sakai et al. | |
| 2006/0146095 | A1 | | 7/2006 | Sakai et al. | |
| 2006/0170734 | A1 | | 8/2006 | Ibe et al. | |

FOREIGN PATENT DOCUMENTS

| | | | | |
|---|---|---|---|---|
| EP | 0 674 995 | A | | 10/1995 |
| EP | 0 768 182 | A | | 4/1997 |
| EP | 0 906 828 | A | | 4/1999 |
| EP | 0 951 999 | A | | 10/1999 |
| JP | 60-116451 | | | 6/1985 |
| JP | 63-59541 | | | 3/1988 |
| JP | 01295857 | | * | 11/1989 |
| JP | 7-195690 | | | 8/1995 |
| JP | 7-314684 | | | 12/1995 |
| JP | 08-112902 | | | 5/1996 |
| JP | 2000-141663 | | | 5/2000 |
| JP | 3382424 | | | 12/2002 |

* cited by examiner

CIRCUIT BOARD FOR INK JET HEAD, METHOD OF MANUFACTURING THE SAME, AND INK JET HEAD USING THE SAME

BACKGROUND OF THE INVENTION

1. Field of the Invention

The present invention relates to a circuit board for an ink jet head that ejects ink for printing, a method of manufacturing the circuit board, and an ink jet head using the circuit board.

2. Description of the Related Art

An ink jet printing system has an advantage of low running cost because an ink jet head as a printing means can easily be reduced in size, print a high-resolution image at high speed and even form an image on so-called plain paper that is not given any particular treatment. Other advantages include low noise that is achieved by a non-impact printing system employed by the print head and an ability of the print head to easily perform color printing using multiple color inks.

There are a variety of ejection methods available for the ink jet head to realize the ink jet printing system. Among others, ink jet heads using thermal energy to eject ink, such as those disclosed in U.S. Pat. Nos. 4,723,129 and 4,740,796, generally have a construction in which a plurality of heaters to heat ink to generate a bubble in ink and wires for heater electrical connection are formed in one and the same substrate to fabricate an ink jet head circuit board and in which ink ejection nozzles are formed in the circuit board over their associated heaters. This construction allows for easy and high-precision manufacture, through a process similar to a semiconductor fabrication process, of an ink jet head circuit board incorporating a large number of heaters and wires at high density. This helps to realize higher print resolution and faster printing speed, which in turn contributes to a further reduction in size of the ink jet head and a printing apparatus using it.

FIG. 1 and FIG. 2 are a schematic plan view of a heater in a general ink jet head circuit board and a cross-sectional view taken along the line II-II of FIG. 1. As shown in FIG. 2, on a substrate 120 is formed a resistor layer 107 as a lower layer, over which an electrode wire layer 103 is formed as an upper layer. A part of the electrode wire layer 103 is removed to expose the resistor layer 107 to form a heater 102. Electrode wire patterns 205, 207 are wired on the substrate 120 and connected to a drive element circuit and external power supply terminals for supply of electricity from outside. The resistor layer 107 is formed of a material with high electric resistance. Supplying an electric current from outside to the electrode wire layer 103 causes the heater 102, a portion where no electrode wire layer 103 exists, to generate heat energy creating a bubble in ink. Materials of the electrode wire layer 103 mainly include aluminum or aluminum alloy.

In such an ink jet head circuit board, the heater 102 is subjected to a severe environment, including a temperature rise and fall as large as 1,000° C. in a short period of time and also mechanical impacts caused by cavitations from repeated creation and collapse of bubbles. To deal with this situation, the heater 102 is insulated and protected from ink by multiple protective layers, which comprise a protective insulation layer 108 of inorganic compounds, such as SiO and SiN, and a metal layer 110 deposited over the insulation layer 108 which is made from a mechanically more stable metal, such as Ta (this layer may also be called an anticavitation layer because of its capability of withstanding damages from cavitations) (see FIG. 2). In addition, the similar construction is also formed over the electrode wire layer 103—which provides electrical connection for the resistor layer 107—to prevent corrosion by ink.

In ink jet printers, there are growing demands in recent years that they have a capability of printing images of high resolution and quality at high speed. This requires a large number of ink ejection nozzles and energy generation elements, such as heaters used to eject ink, to be formed in a substrate at high density. In arranging a large number of nozzles and energy generation elements in the substrate at high density, a reduction in power consumption by the energy generation elements is particularly important.

An example construction capable of reducing power consumption by the energy generation elements is disclosed in Japanese Patent No. 3382424.

FIG. 3 shows a schematic cross-section of a heater in an ink jet head circuit board disclosed in Japanese Patent No. 3382424, the cross-sectioned portion corresponding in position to the line II-II of FIG. 1. In this construction, first and second protective insulation layers 108*a*, 108*b* are formed over the electrode wire layer 103, with the lower layer or the first protective insulation layer 108*a* removed from above the heater 102. That is, Japanese Patent No. 3382424 discloses a construction in which an overall thickness of the protective layer over the heater is made smaller than that over the electrode wire. This construction improves an energy efficiency by reducing the effective thickness of the protective layer over the heater 102 and at the same time provides a required protective insulation function by the second protective insulation layer 108*b*. This construction therefore can achieve a reduction in power consumption by the heater without degrading the protective performance of the protective layer.

In addition to improving the thermal efficiency of the heaters, it is also important to reduce resistances of electrode wires from the standpoint of reducing an overall power consumption of the circuit board. Normally, a reduction in resistance of the electrode wires is achieved by increasing the width of the electrode wires formed on the board. However, as the number of heaters or energy generation portions formed on the board becomes very large for the reason described above, a sufficient space to accommodate widened electrode wires cannot be secured without increasing the size of the circuit board.

In this circumstance, the inventors of this invention studied the possibility of reducing the electrode wire resistance by increasing the thickness of the electrode wires. Having built a construction in which the electrode wires are increased in thickness and in which the total thickness of the protective layers over the heaters is made smaller than the total thickness of the protective layers over the electrode wires, as shown in FIG. 3, the inventors of this invention have found a new problem as described below.

Considering the coverage over the stepped portions of the electrode wires bordering the heaters, the protective layers need to be increased in thickness as the electrode wire thickness becomes large. This prevents the protective layers over the heaters from being formed sufficiently thin or results in an increase in a space or area accommodating the thick portion of the protective layers over the heaters. As a result, the advantage of a reduced power consumption of the heaters brought about by the above construction is offset by these disadvantages.

SUMMARY OF THE INVENTION

It is therefore a primary object of this invention to reduce wire resistances and at the same time improve heat efficiency for reduced power consumption in a process of integrating heaters at high density in a circuit board to achieve a high-resolution printing, a high quality of printed image and a high printing speed.

Another object of this invention is to provide a small, highly reliable ink jet head with nozzles formed at high density.

In a first aspect of the present invention, there is provided an ink jet head circuit board having heaters to generate thermal energy for ejecting ink as the heater are energized, the ink jet head circuit board comprising:

a resistor layer and a first electrode wire layer to form the heater;

a first protective layer formed on the first electrode wire layer;

a second electrode wire layer formed on the first protective layer and electrically connected to the first electrode wire layer; and a second protective layer formed on the second electrode wire layer;

wherein one of the first protective layer and the second protective layer covers the heater, the covering layer corresponding to the first electrode wire layer or the second electrode wire layer whichever having a smaller thickness.

In a second aspect of the present invention, there is provided a method of manufacturing an ink jet head circuit board, wherein the ink jet head circuit board has heaters to generate thermal energy for ejecting ink as the heaters are energized, the method comprising the steps of:

forming the heater on a substrate by a resistor layer and a first electrode wire layer;

forming a first protective layer on the first electrode wire layer;

forming a second electrode wire layer on the first protective layer and electrically connecting the second electrode wire layer to the first electrode wire layer;

forming a second protective layer on the second electrode wire layer; and removing at an area over the heater one of the first protective layer and the second protective layer, the one of the layers to be removed corresponding to the first electrode wire layer or the second electrode wire layer whichever having a larger thickness.

In a third aspect of the present invention, there is provided an ink jet head comprising:

the above ink jet head circuit board; and ink ejection nozzles corresponding to the heaters.

With this invention, the electrode wires are formed of a plurality of layers to reduce wire resistances and prevent a size increase of the circuit board. This construction enables high density integration of the heaters required to achieve a high resolution printing, a high printed image quality and a high speed printing. Since in this construction the effective thickness of the protective layers over the heaters can be reduced, the thermal efficiency can be enhanced and the power consumption reduced.

With this invention, a small, highly reliable ink jet head having nozzles formed at high density can be provided.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, the present invention will be described in detail by referring to the accompanying drawings.

First Embodiment of Ink Jet Head Circuit Board and Process of Manufacturing the Same In this invention, electrode wires are formed of a plurality of layers, i.e., at least two, upper and lower, layers (the lower layer is hereinafter referred to as a first electrode wire layer and the upper layer as a second electrode wire layer). A protective insulation layer for protecting the first electrode wire layer (hereinafter referred to as a first protective insulation layer) or a protective insulation layer for protecting the second electrode wire layer (hereinafter referred to as a second protective insulation layer) is removed from above the heater to reduce the effective thickness of the protective layer over the heater, thus preventing a degradation of heat efficiency. Other areas than the heater are covered with the first and second protective insulation layers to secure a reliable protection and insulation of the electrodes. Further, considering the thicknesses of the first and second electrode wire layers, protective insulation layer formed over a thicker electrode wire layer is removed.

Figure 1:
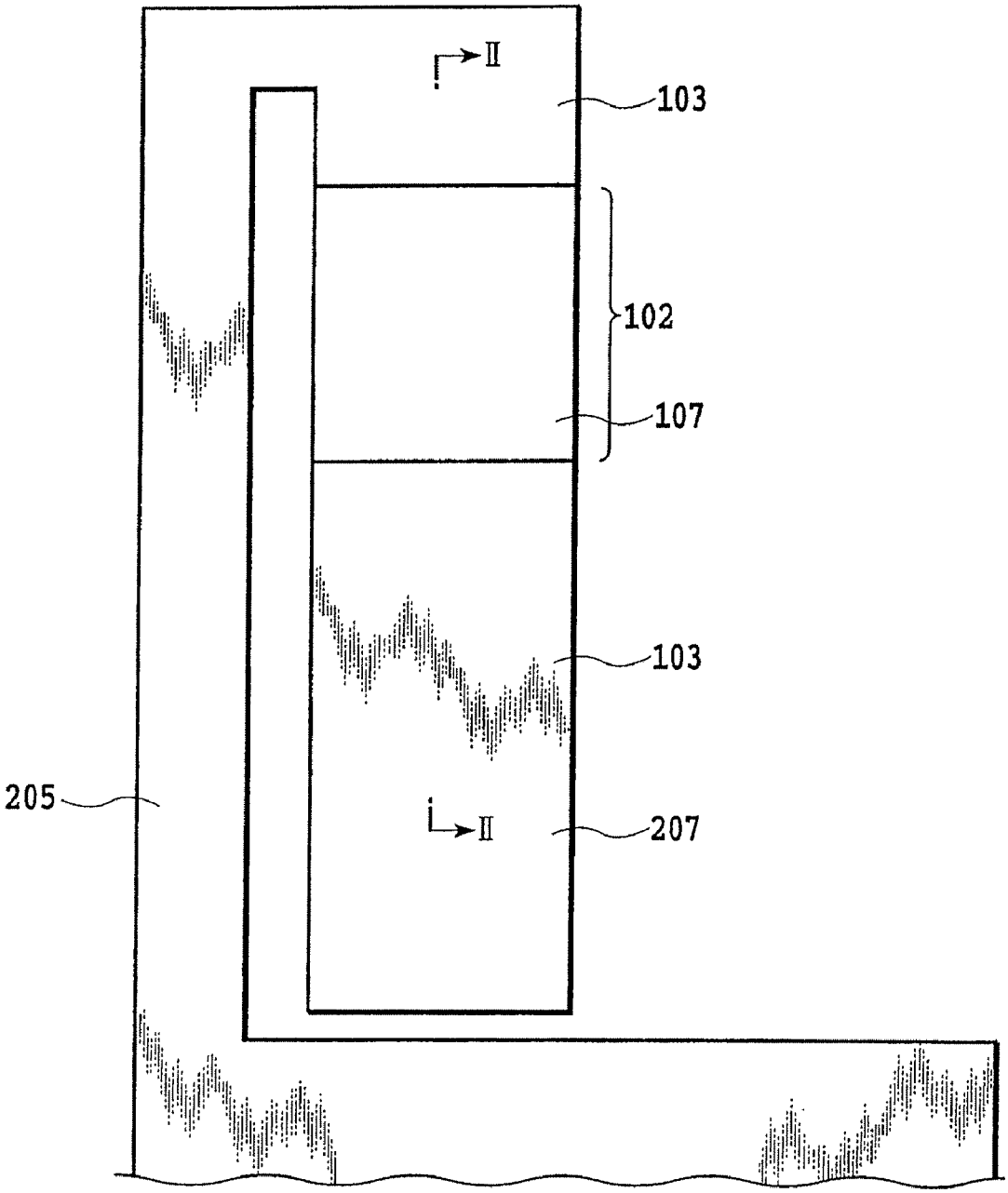
FIG.1 PRIOR ART
FIG. 1 is a schematic plan view showing a heater in a conventional ink jet head circuit board.
Figure 2:
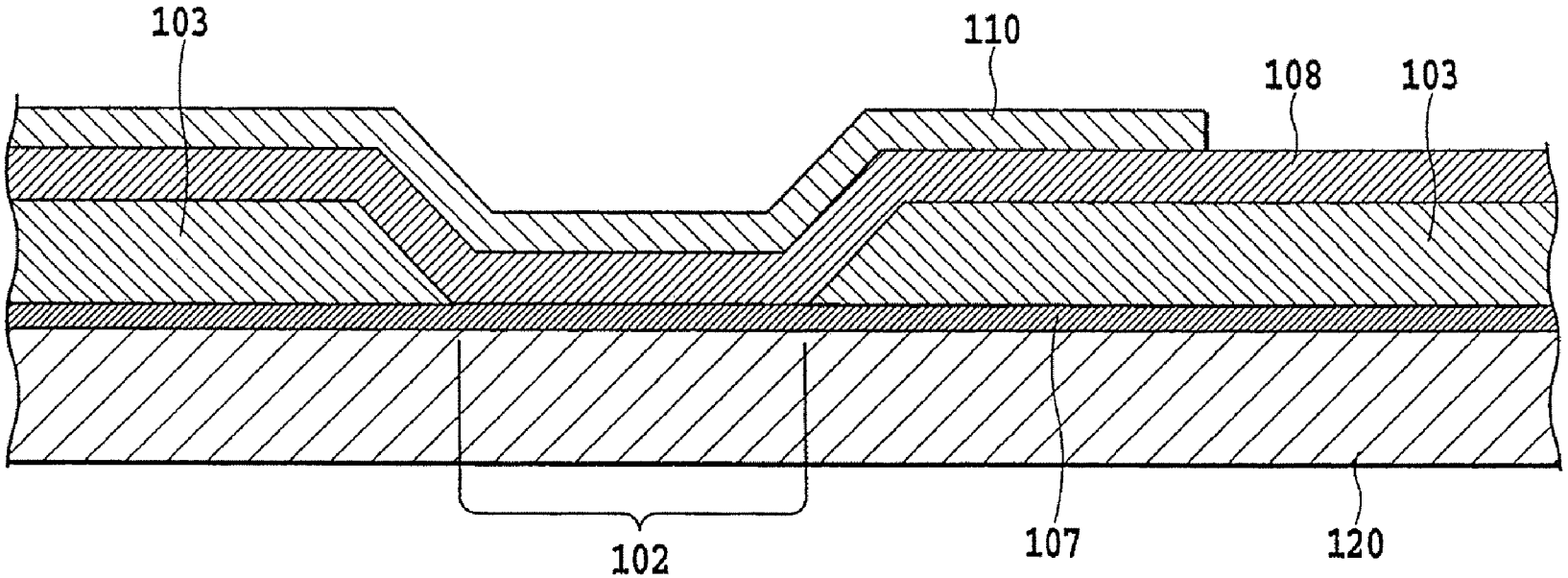
FIG.2 PRIOR ART
FIG. 2 is a cross-sectional view taken along the line II-II of FIG. 1.
Figure 3:
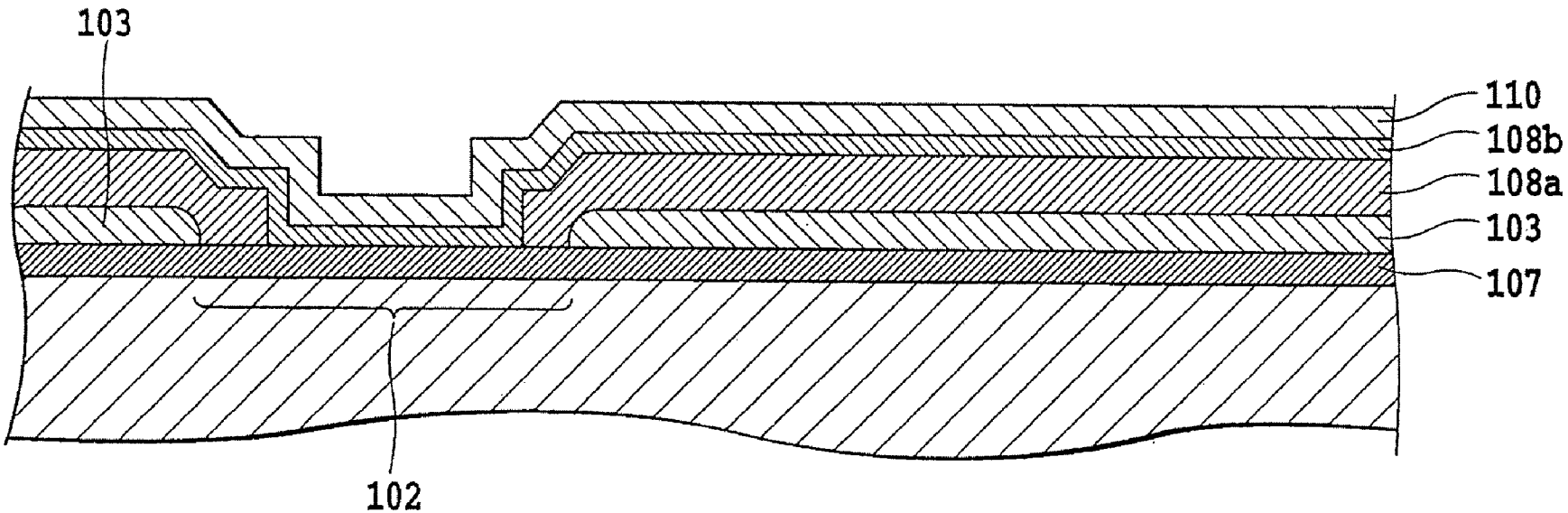
FIG.3 PRIOR ART
FIG. 3 is a schematic cross-sectional view showing a heater in another conventional ink jet head circuit board.
Figure 4:
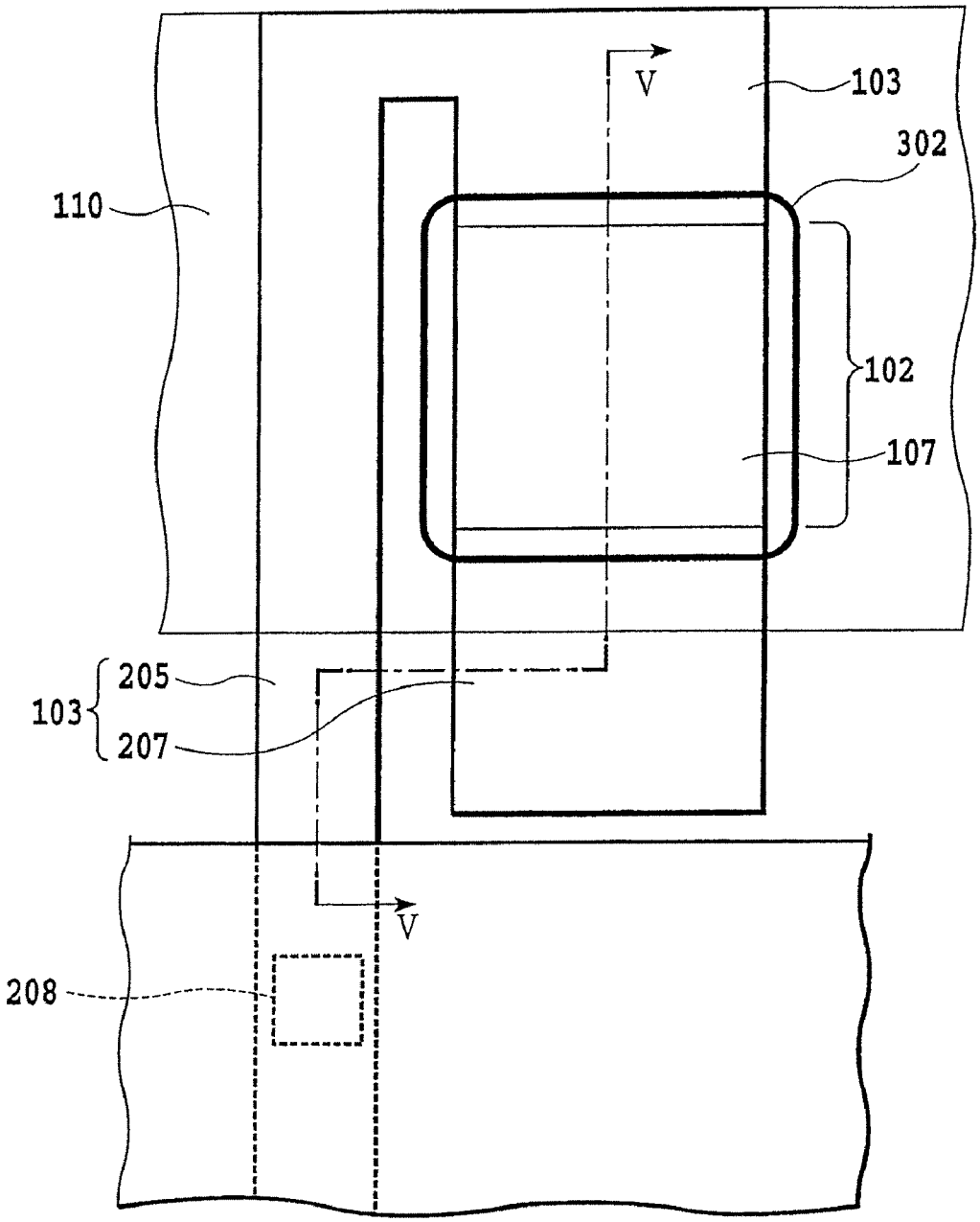
FIG. 4 is a schematic plan view showing a heater in an ink jet head circuit board according to a first embodiment of this invention.
Figure 5:
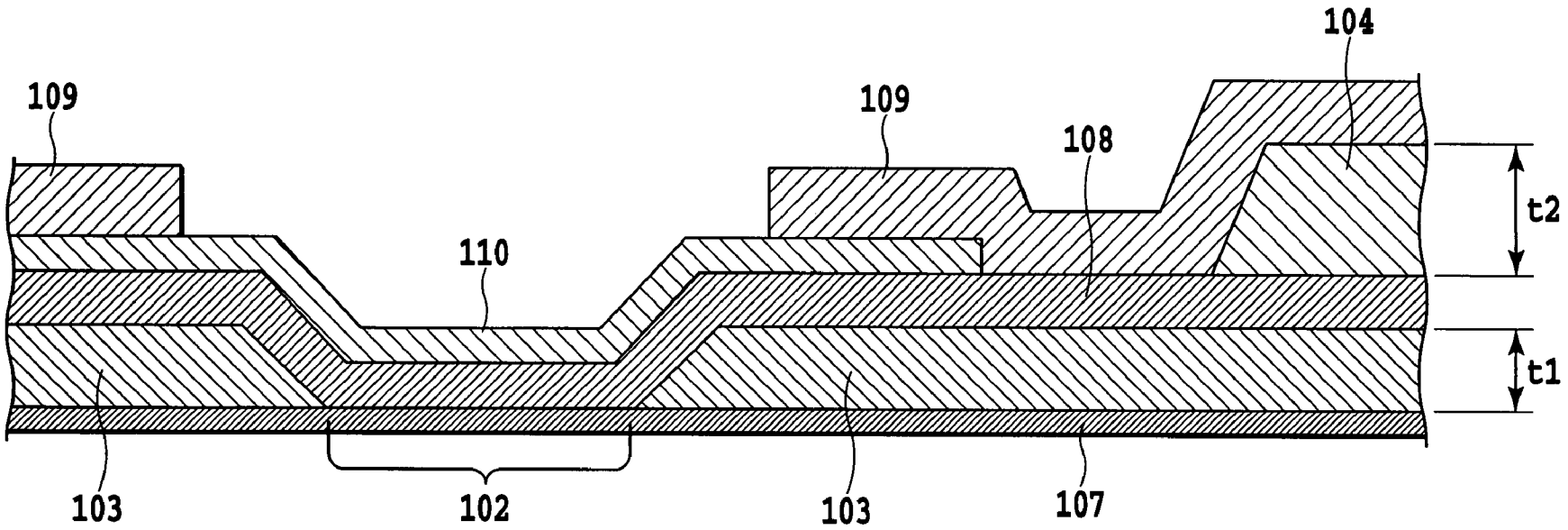
FIG. 5 is a cross-sectional view taken along the line V-V of FIG. 4.

FIG. 4 and FIG. 5 are a schematic plan view showing a heater in the ink jet head circuit board according to the first embodiment of this invention and a schematic cross-sectional view taken along the line V-V of FIG. 4, respectively. In these figures, components that function in the same way as those in FIG. 1 to FIG. 3 are given like reference numbers.

In this example, a second electrode wire layer 104 is formed over a first electrode wire layer 103 with a first protective insulation layer 108 in between. These electrode wire layers are interconnected with each other via a through-hole 208 (FIG. 4). Thus, near the heater 102, current paths are formed running from the second electrode wire layer 104 and the through-hole 208 to the first electrode wire layer 103 in the right-hand side of FIG. 5 and the resistor layer 107 and to the first electrode wire layer 103 in the left-hand side of FIG. 5. Over the second electrode wire layer 104 is formed a second protective insulation layer 109. At locations corresponding to the heater 102, an anticavitation layer 110 is formed.

In the construction of this embodiment, the first electrode wire layer 103 and the second electrode wire layer 104 have a thickness relation of $t1<t2$, where $t1$ is a thickness of the first electrode wire layer 103 and $t2$ is a thickness of the second electrode wire layer 104. The anticavitation layer 110 is formed over the first protective insulation layer 108 over which the second electrode wire layer 104 is formed. Next, as stipulated by this invention, the second protective insulation layer 109 is formed over these layers. The second protective insulation layer 109 is then removed from a portion 302 above the heater 102.

Referring to FIG. 6 to FIG. 13, an example process of manufacturing the ink jet head circuit board of FIG. 4 and FIG. 5 will be explained.

Figure 6:
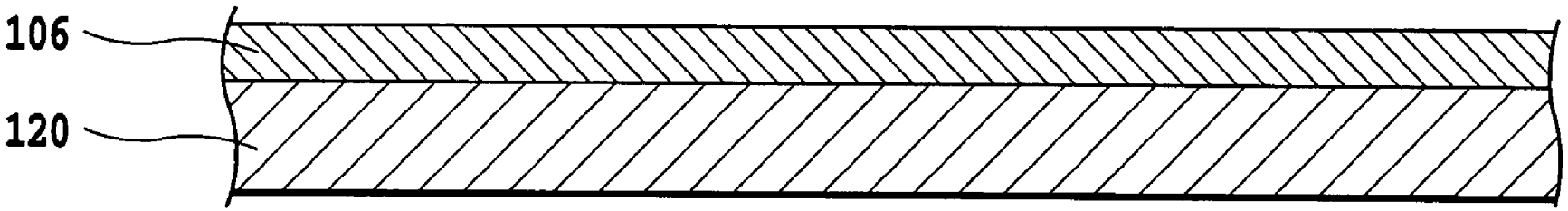
FIG. 6 to FIG. 13 are schematic cross-sectional views showing a process of fabricating the circuit boards shown in FIG. 4 and FIG. 5.

First, in FIG. 6, a heat accumulating layer 106 is formed over a substrate 120 of Si by thermal oxidation. Here, the substrate 120 may have prefabricated in a <100> Si substrate a drive circuit, made up of semiconductor elements such as switching transistors, to selectively drive the heater 102.

Figure 7:
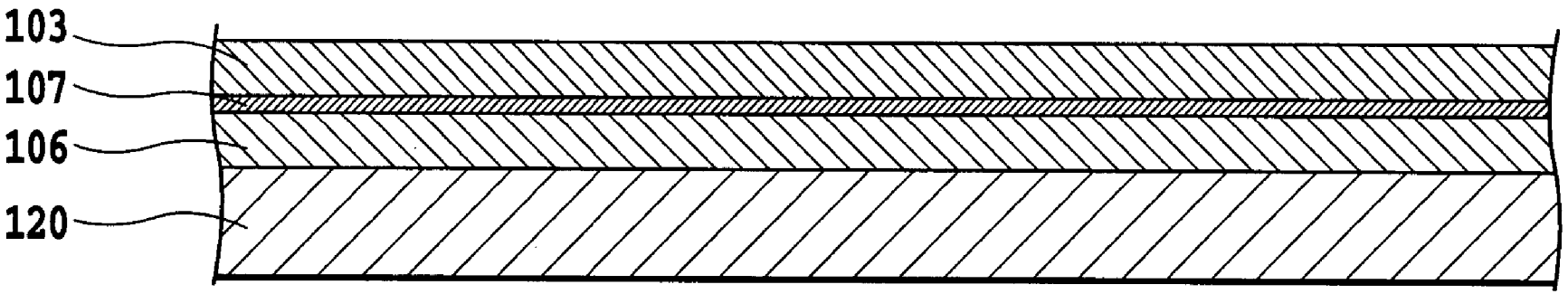

Next, as shown in FIG. 7, the resistor layer 107 of, for example, TaSiN is sputtered to a thickness of about 30 nm and then the first electrode wire layer 103 of, say, Al is deposited to a thickness of about 300 nm ($t1$). The first electrode wire layer 103 and resistor layer 107 in FIG. 7 are etched by photolithography using the reactive ion etching (RIE) method to obtain a desired planar shape. The first electrode wire layer is used to form wire patterns very close to the heaters (corresponding to wire patterns 205N, 205F1 in FIG. 14B described later) and wire patterns running from terminals (corresponding to a terminal 205T in FIG. 14B) to the first wire patterns.

Figure 8:
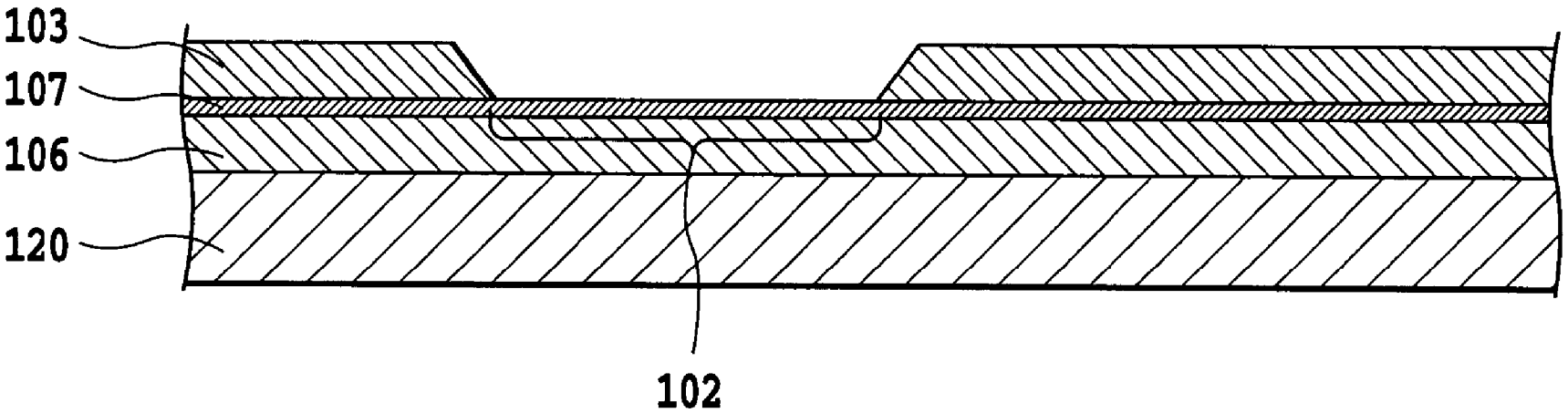

Next, the first electrode wire layer 103 of Al is partly etched away by photolithography using wet etching to expose the resistor layer 107 thereby forming the heater 102 as shown in FIG. 8. To improve the coverage of the first protective insulation layer at the wire terminals, it is desired that a known wet etching that produces an appropriate tapered shape at the wire terminals be performed.

Figure 9:
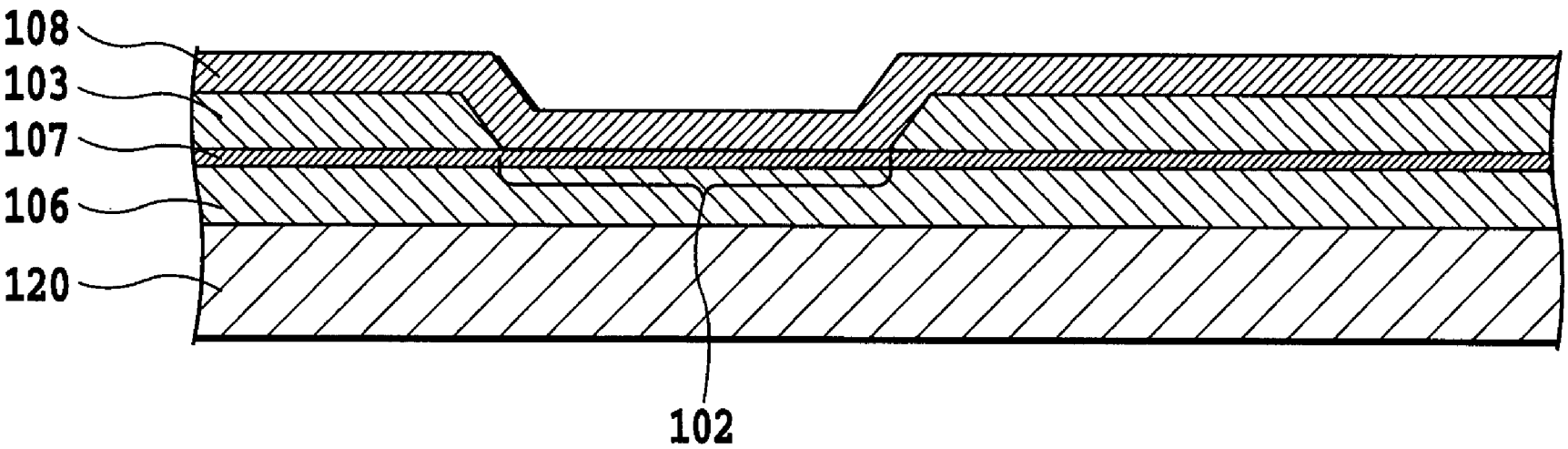

Next, as shown in FIG. 9, the first electrode wire layer 103 including the exposed resistor layer 107 (heater 102) is deposited, by the plasma CVD method, with an SiN layer of about 300 nm thick which forms a first protective insulation layer 108. The thickness of the SiN layer is such as will fully cover the first electrode wire layer 103, cause no degradation of thermal efficiency and secure an enough dielectric breakdown voltage with respect to a second electrode wire layer to be formed later.

Figure 10:
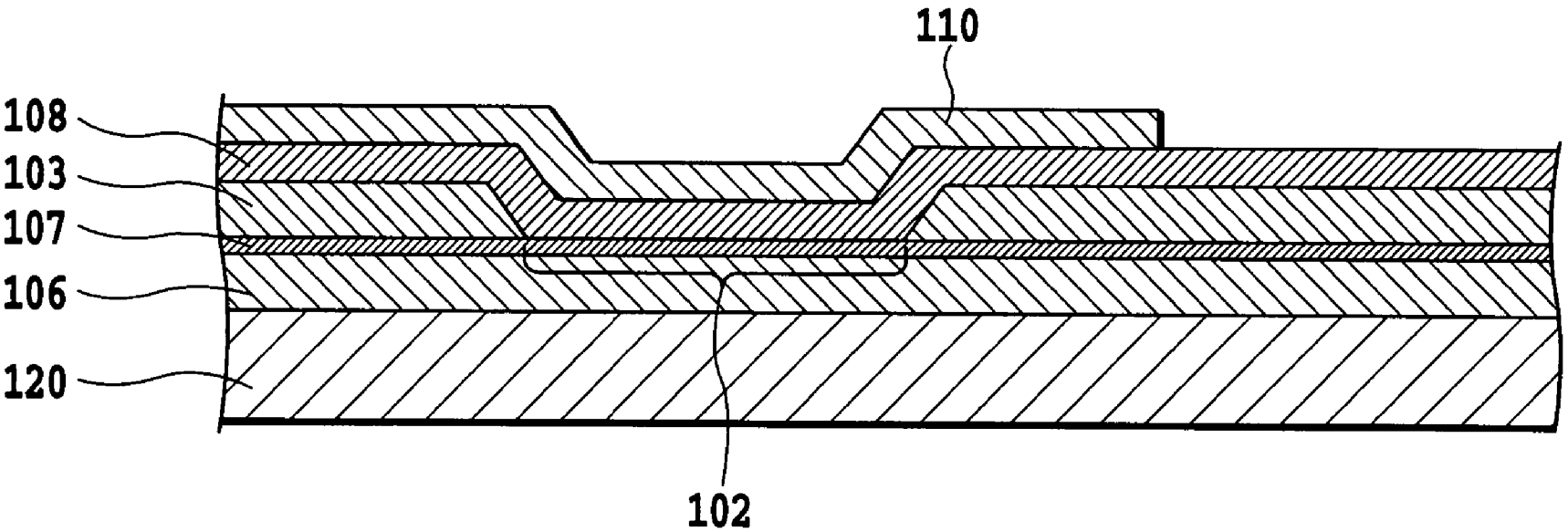

Then, as shown in FIG. 10, a Ta layer 110 as the anticavitation and ink resistant layer is sputtered to a thickness of about 230 nm and then formed to a desired shape by photolithography using dry etching. To ensure that the first electrode wire pattern 205 on the power supply side and the second electrode wire to be formed later are connected as required, as shown in FIG. 4, the first protective insulation layer 108 is formed with a through-hole 208 by photolithography using dry etching. The Ta layer has a higher thermal conductivity than that of the protective insulation layer and therefore does not degrade the heat efficiency significantly. This also applies to the second and third embodiment described later.

Figure 11:
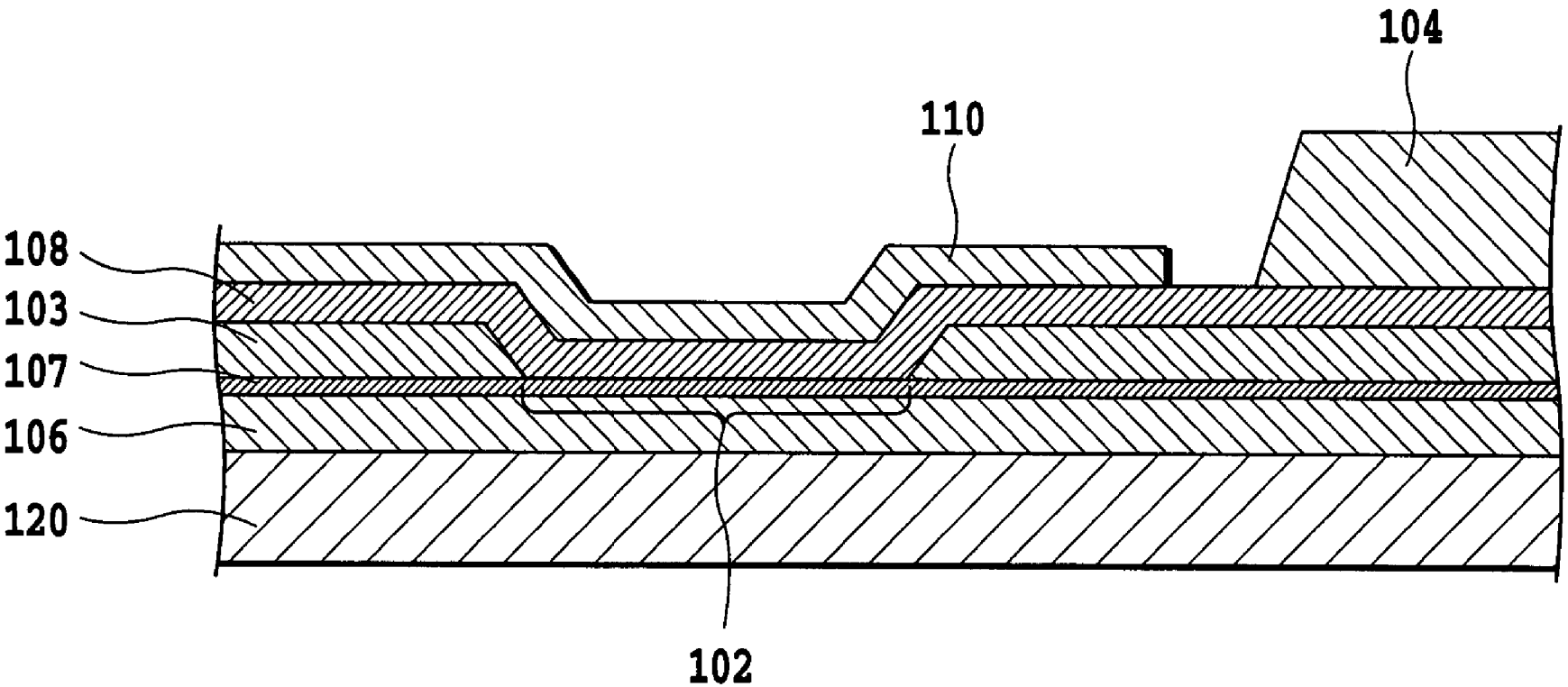

Next, as shown in FIG. 11, the second electrode wire layer 104 is sputtered to a desired thickness ($t2>t1$) and formed to a desired shape by photolithography using wet etching. The second electrode wire layer is laid over the first electrode wire layer that forms a wire pattern running from the terminals to the wire pattern in direct vicinity of the heater.

Figure 12:
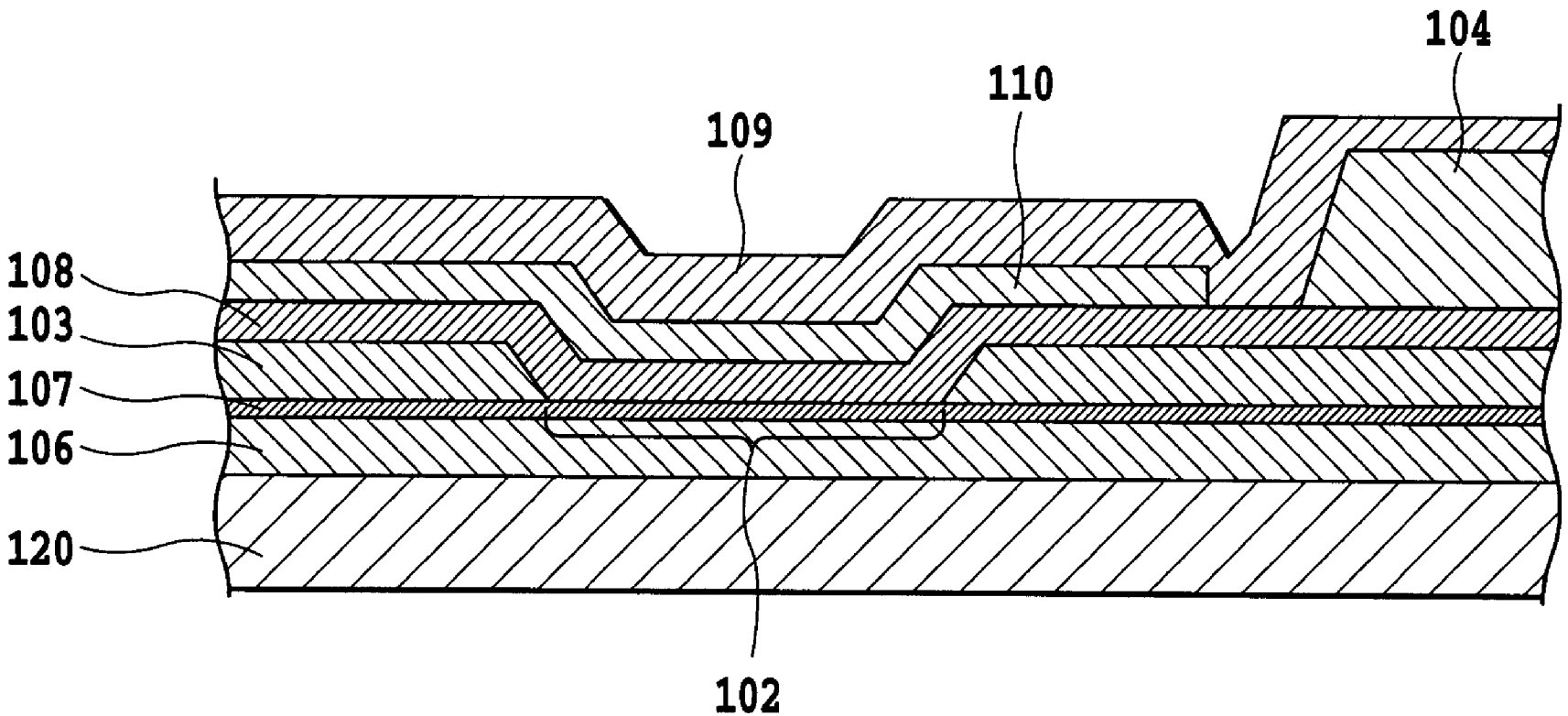
Figure 13:
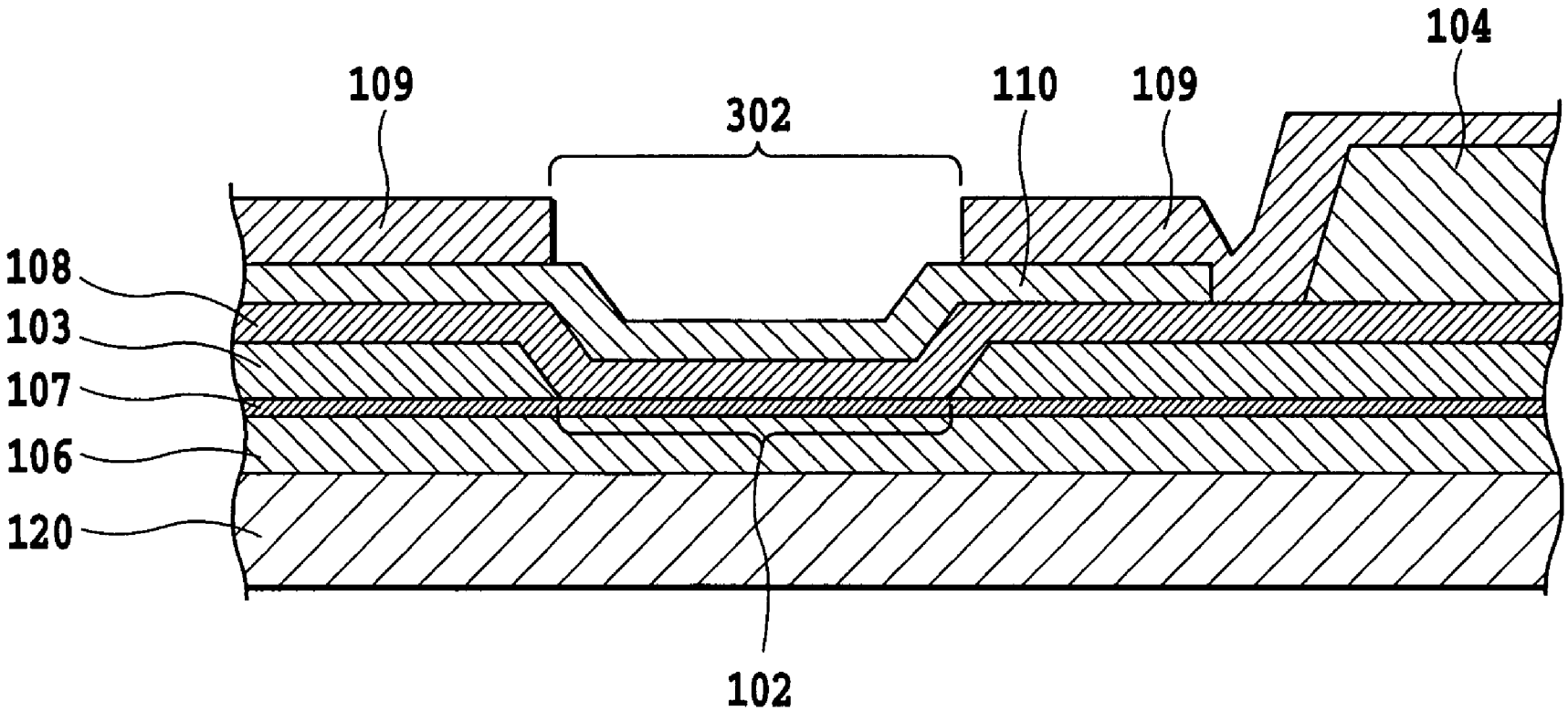

Next, as shown in FIG. 12, an SiO layer is formed as the second protective insulation layer 109 by the plasma CVD method. Then, as shown in FIG. 13, the second protective insulation layer 109 over the heater 102 is dry-etched away (at portions indicated at 302 in FIG. 4), with the anticavitation layer 110 as an etch stopper, as shown in FIG. 13.

With the above process, the ink jet head circuit board is completed.

Superiority of First Embodiment

Fabricating the circuit board in the process described above can not only reduce the resistance of wires and the effective thickness of the protective insulation layer over the heater 102, improve a heat efficiency and reduce an overall power consumption, but also contribute to a higher density of heaters which in turn will realize higher resolution and quality of printed images and a faster printing speed.

More specifically, the fact that the electrode wires are constructed of a plurality of layers to reduce wire resistance prevents the circuit board from becoming large in size and allows heaters and nozzles to be formed in high density, assuring an improved resolution and quality of printed images and a faster printing speed. In reducing the resistance of electrode wires, a conventional practice involves increasing the width of the electrode wires formed on the circuit board. However, as the number of heaters formed on the board becomes huge, a sufficient space for widening the electrode wires cannot be secured without increasing the size of the board.

Figure 14A:
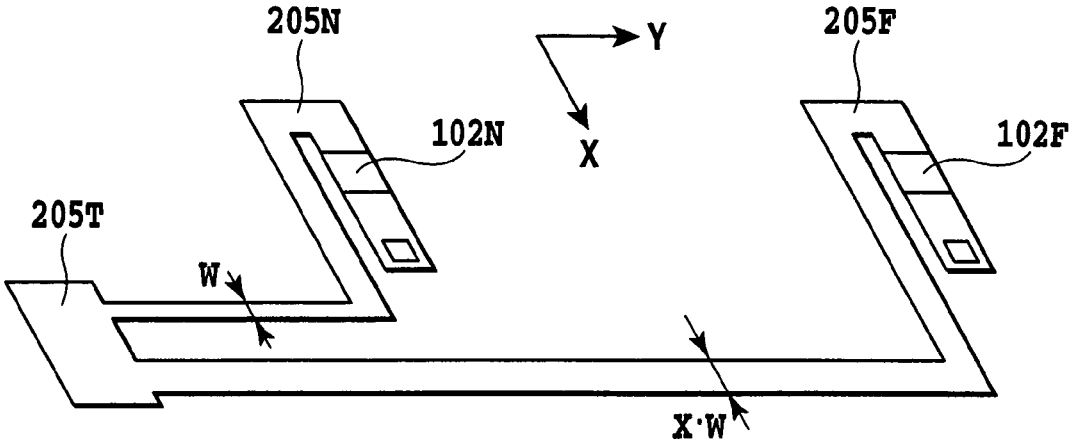
FIG. 14A and FIG. 14B show a problem with the conventional construction in reducing or equalizing resistances of electrode wires in the heaters and also a superiority of a fundamental construction adopted by the first embodiment over the conventional construction, respectively.
Figure 14B:
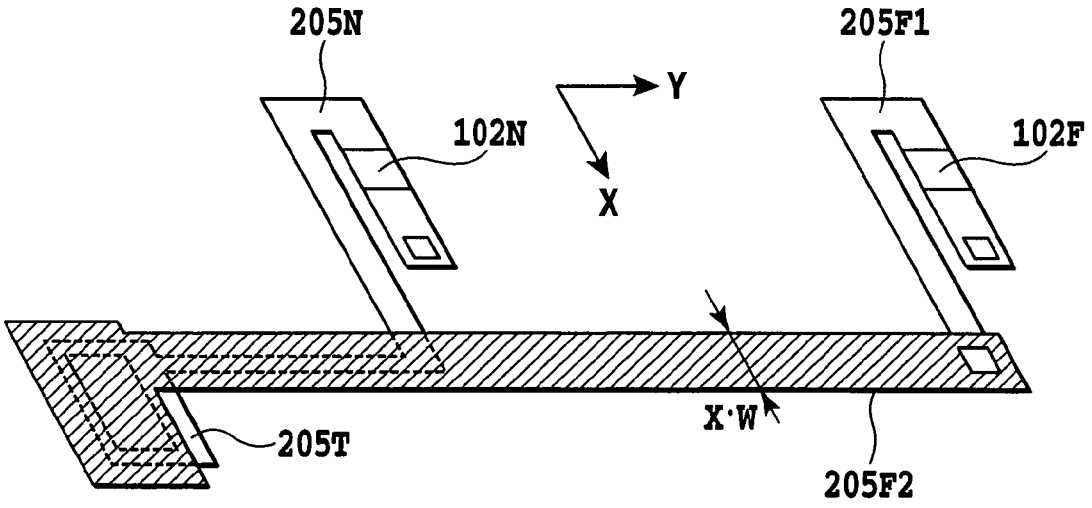

This is explained by referring to FIG. 14A.

In FIG. 14A, suppose a wire pattern 205N for a heater 102N near a terminal 205T located at an end of the circuit board (not shown) has a width W in its wire portion extending in Y direction. Then, a wire pattern 205F for a heater 102F remote from the terminal 205T has a width $x \cdot W$ ($x>1$) in its wire portion extending in Y direction in the figure. This is because the distance from the terminal 205T to each heater, i.e., the length of wire, is not uniform and its resistance varies according to the distance from the terminal 205T. As described above, in a construction designed to reduce or equalize the wire resistances in the same plane, the circuit board is required to have an area that matches the sum of the widths of wire portions for individual heaters (the farther the heater is from the terminal, the larger the width of the associated wire portion becomes).

Thus, when it is attempted to increase the number of heaters to achieve a higher resolution and quality of printed images and a faster printing speed, the size of the circuit board in X direction increases even more significantly, pushing up the cost and limiting the number of heaters that can be integrated. As for the wire portions in direct vicinity of the heaters, increasing the width in Y direction to reduce the wire resistance can impose limitations on the intervals of heaters and the high density arrangement of nozzles.

On the other hand, in the construction of this embodiment that uses a plurality of layers for the electrode wires to reduce or equalize wire resistances, the wire pattern 205N for the heater 102N near the terminal 205T and the wire pattern 205F1 in direct vicinity of the heater 102F, which is remote from the terminal 205T, are both formed of the lower layer or the first electrode wire layer, and a wire portion 205F2 extending in Y direction to the wire portion 205F1 is formed of the upper layer or the second electrode wire layer, as shown in FIG. 14A, with the ends of the wire portion 205F2 connected to the terminal 205T and the wire portion 205F1 via through-holes. In this construction, the circuit board is only required to have an area large enough to accommodate the width (x·W) of the upper wire portion 205F2, making it possible to reduce the surface area of the circuit board while reducing or equalizing the wire resistance.

Compared with a construction that reduces or equalizes wire resistances by increasing the thickness of the electrode wires, the construction of this embodiment can alleviate the patterning precision and thereby prevent a possible deterioration of coverage of the protective insulation layer and the anticavitation layer.

In particular, this invention does not just remove one of the protective insulation layers from above the heater. It also considers the thickness relation between the first and second electrode wire layers. Although the thickness relation between the first and second electrode wire layers can be determined appropriately based on design conditions, such as a reduction in overall wire resistance for one heater and a reduction in resistance variations among heaters, the first electrode wire layer 103 directly connected to the heater 102 is made thinner than the second electrode wire layer 104 in this embodiment. This allows a step of the first electrode wire layer 103 in the heater 102 to be formed small, so that the first protective insulation layer 108, if relatively thin, can produce a satisfactory coverage. Therefore, in this embodiment, the first protective insulation layer 108 is left above the heater and the second protective insulation layer 109, which is required to be relatively thick, is removed. In other words, the whole electrode wires are securely protected by two protective insulation layers while at the same time the effective thickness of the protective layer over the heater is reduced to improve the heat efficiency.

As for the supply of electricity from a terminal (corresponding to the terminal 205T in FIG. 14B) to wire patterns in direct vicinity of the heaters (corresponding to wire patterns 205N, 205F1 in FIG. 14B), one or both of the first and second electrode wire layer may be used in order to reduce an overall wire resistance for the heaters of interest and equalize wire resistances among different heaters. For example, for the heater close to the terminal, only the first electrode wire may be used (in this case, the through-hole 208 is not used). For the heater remote from the terminal, both of the electrode wires may be used.

For those wire patterns close to the heaters, the resistance reduction may also be achieved by using two layers for the electrode wires in a manner described above and interconnecting the two layers via an appropriate number of through-holes to allow the heaters to be energized through either of the two layers.

Figure 15:
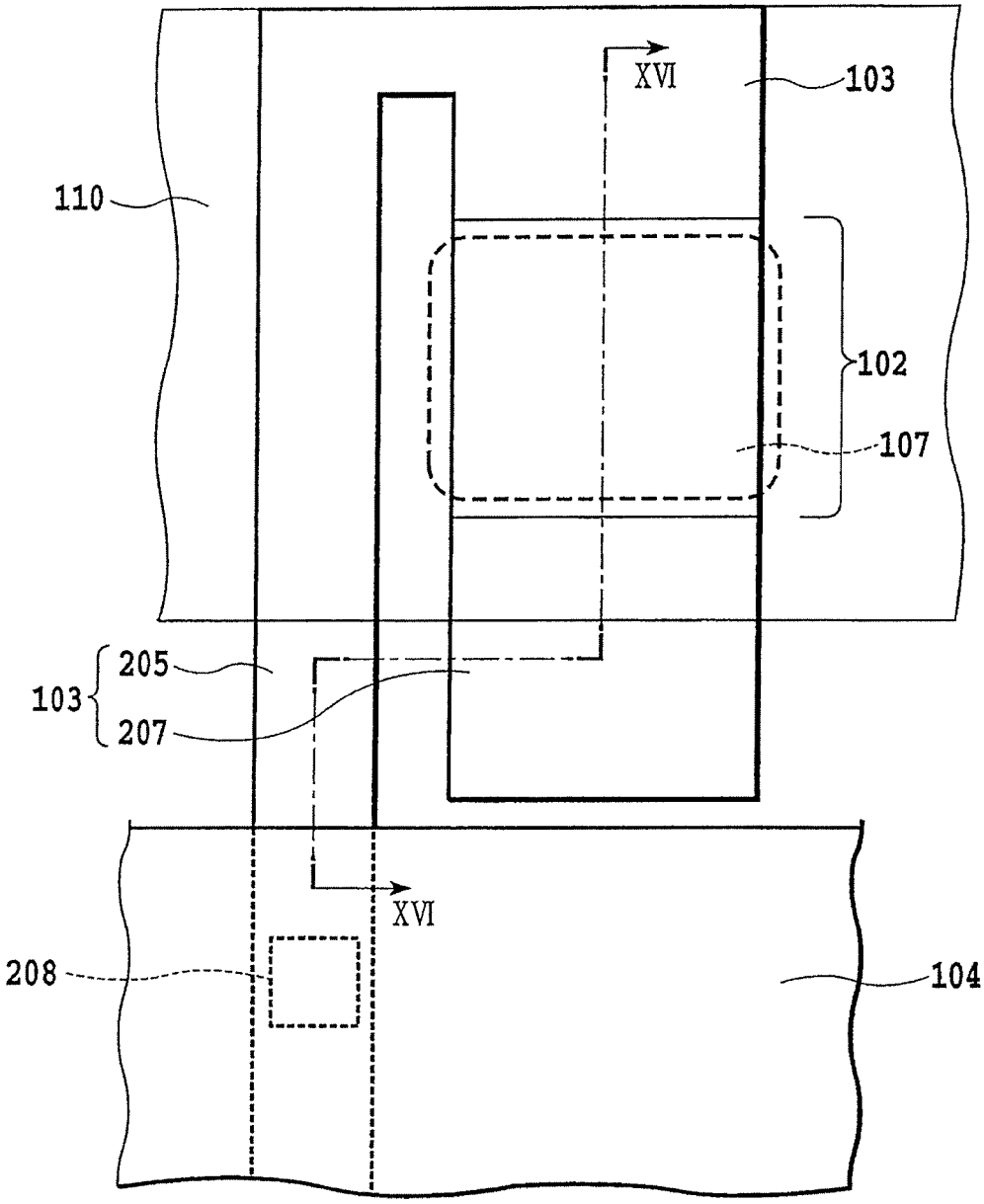
FIG. 15 is a schematic plan view showing a heater in an ink jet head circuit board according to a second embodiment of this invention.
Figure 16:
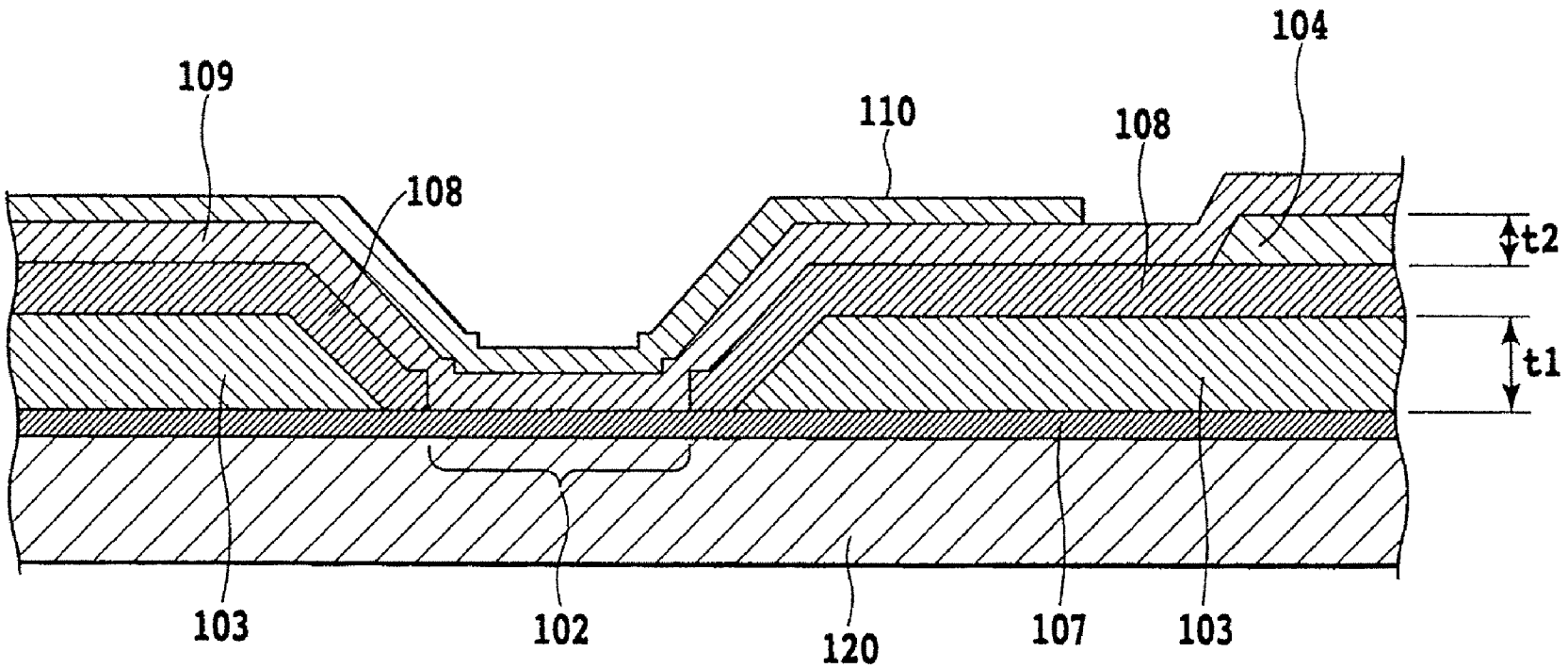
FIG. 16 is a cross-sectional view taken along the line XVI-XVI of FIG. 15.

Second Embodiment of Ink Jet Head Circuit Board and Process of Manufacturing the Same FIG. 15 and FIG. 16 are a schematic plan view showing a heater in the ink jet head circuit board according to the second embodiment of this invention and a schematic cross-sectional view taken along the line XVI-XVI of FIG. 15, respectively. In these figures, components that function in the same way as those of the conventional construction and the first embodiment are given like reference numbers.

In the construction of this embodiment, the first electrode wire layer 103 and the second electrode wire layer 104 have a thickness relation of t1>t2, where t1 is a thickness of the first electrode wire layer 103 and t2 is a thickness of the second electrode wire layer 104. Next, as stipulated by this invention, after the first protective insulation layer 108 is formed, it is removed from portions 301 above the heater 102.

Referring to FIG. 17 through FIG. 20, an example process of manufacturing the ink jet head circuit board shown in FIG. 15 and FIG. 16 will be explained.

In the process similar to the one shown in FIG. 6 to FIG. 9 of the first embodiment, the substrate 120 is deposited successively with a heat accumulating layer 106, a resistor layer 107 and a first electrode wire layer 103. After a desired planar shape is obtained, the first electrode wire layer 103 is partially removed to expose the resistor layer 107 thereby forming the heater 102. Then a first protective insulation layer 108 is formed. In this embodiment, the first electrode wire layer 103 is formed to a thickness of about 600 nm (t1) and the first protective insulation layer 108 is formed of a SiO layer about 600 nm thick.

Figure 17:
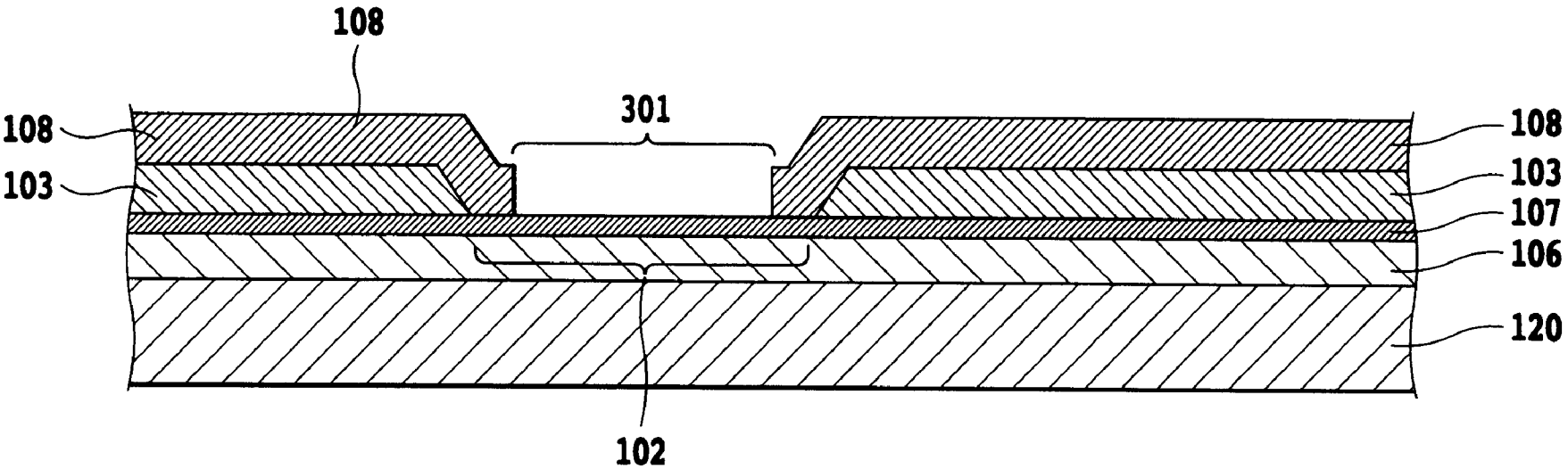
FIG. 17 to FIG. 20 are schematic cross-sectional views showing a process of fabricating the circuit boards shown in FIG. 15 and FIG. 16.

Next, as shown in FIG. 17, with the resistor layer 107 as an etch stopper, the SiO layer is etched away from above the heater 102 (a portion indicated by reference number 301 in FIG. 15). The SiO layer is also etched away (at 208 in FIG. 15) to form a through-hole for interconnection between the first electrode wire pattern on the power supply side and the second electrode wire, as required.

Figure 18:
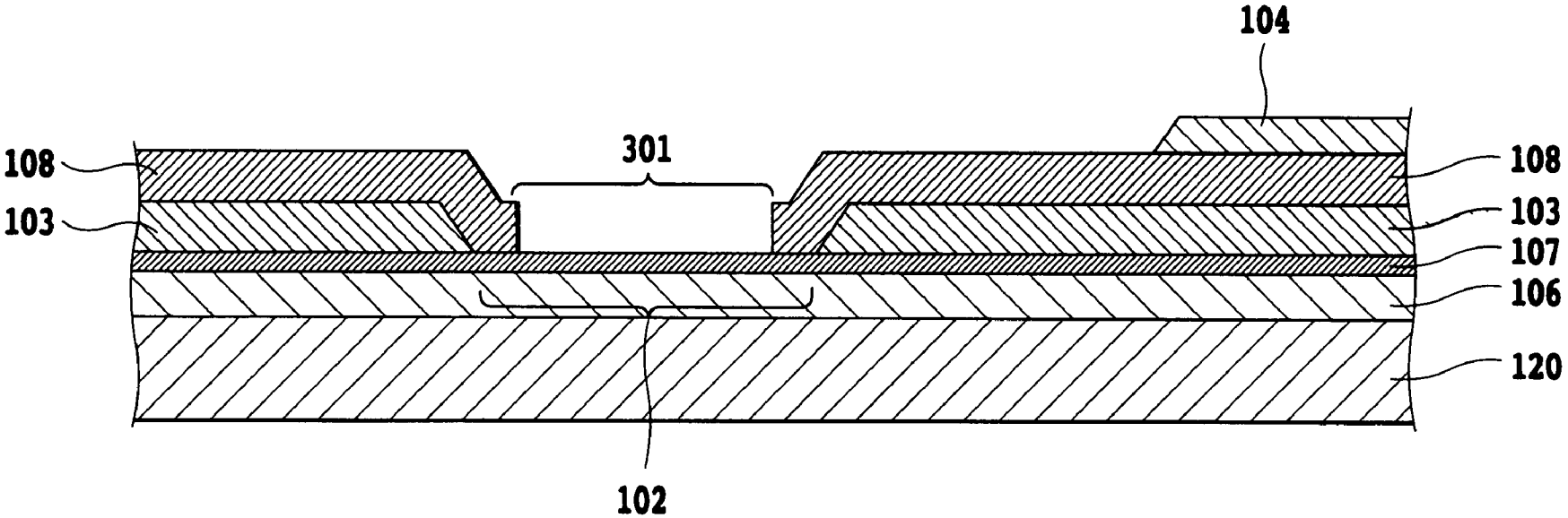

Next, as shown in FIG. 18, aluminum is sputtered to a thickness of about 300 nm (=t2<t1) to form the second electrode wire layer 104, which is then etched to form a desired pattern by photolithography using wet etching.

Figure 19:
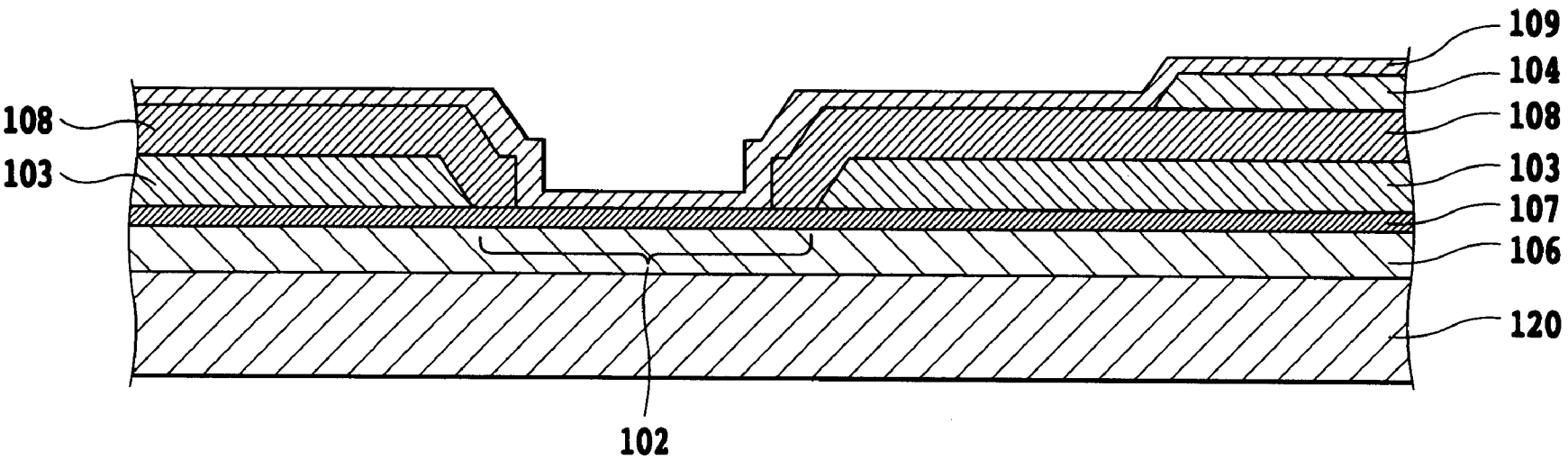

Next, as shown in FIG. 19, a SiN layer is deposited by the plasma CVD method to a thickness of about 300 nm to form a second protective insulation layer 109. The thickness of this SiN layer is such as will fully cover the second electrode wire layer 104 and will not deteriorate heat conductivity.

Figure 20:
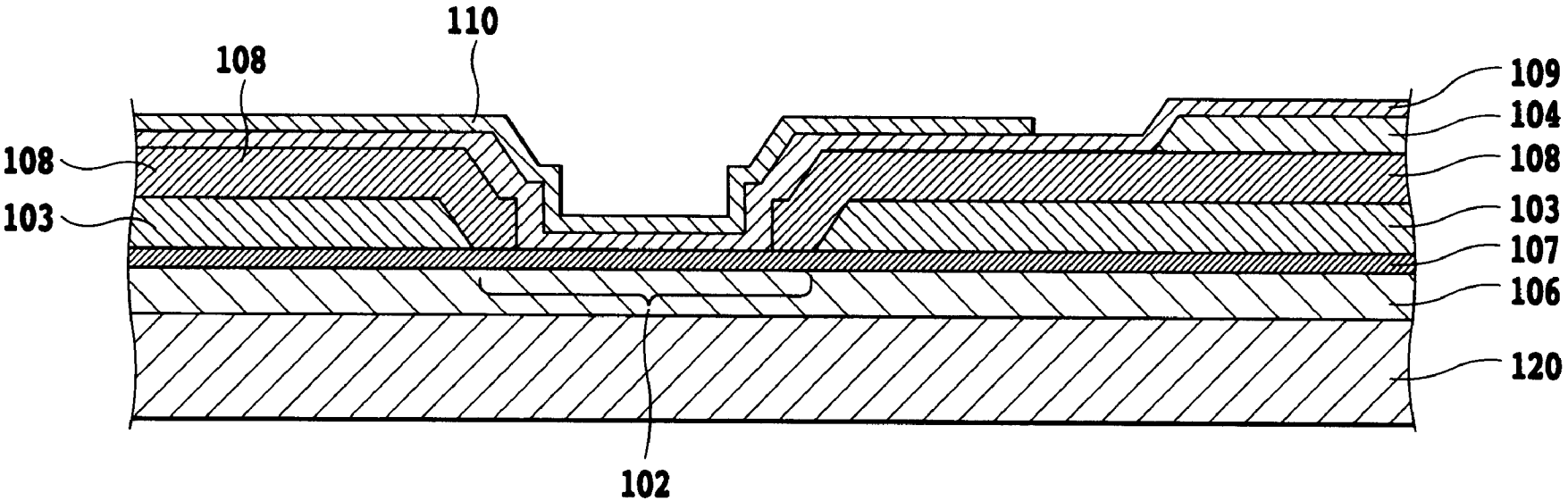

Next, as shown in FIG. 20, a Ta layer 110 as an anticavitation and ink resistant layer is sputtered to a thickness of about 230 nm and then etched into a desired shape by photolithography using dry etching.

With the above process, the ink jet head circuit board is complete.

With the above process, the effective thickness of the protective insulation layer over the heater 102 can be reduced, preventing a degradation of thermal efficiency and substantially reducing the area that the wire pattern for one heater occupies on the substrate.

The thickness relation between the first and second electrode wire layer is appropriately determined based on the design condition concerning wire resistance reduction. In the case of this embodiment, the first electrode wire layer 103 directly connected to the heater 102 is made thicker than the second electrode wire layer 104. The first protective insulation layer 108 is thus formed relatively thick for a secure coverage. In such a case, the first protective insulation layer 108 is partially holed (removed) to achieve a reduction in the effective thickness of the protective layer over the heater 102.

While in this embodiment the resistor layer is used as an etch stopper, the etch stopper may be chosen appropriately according to the protective insulation layer to be etched away and to the thickness relation of the first and second electrode wire.

Third Embodiment of Ink Jet Head Circuit Board and Process of Manufacturing the Same Although the preceding embodiments employ the two-layer construction for the electrode wires for heater 102, the similar philosophy can be applied where three or more layers are used.

Figure 21:
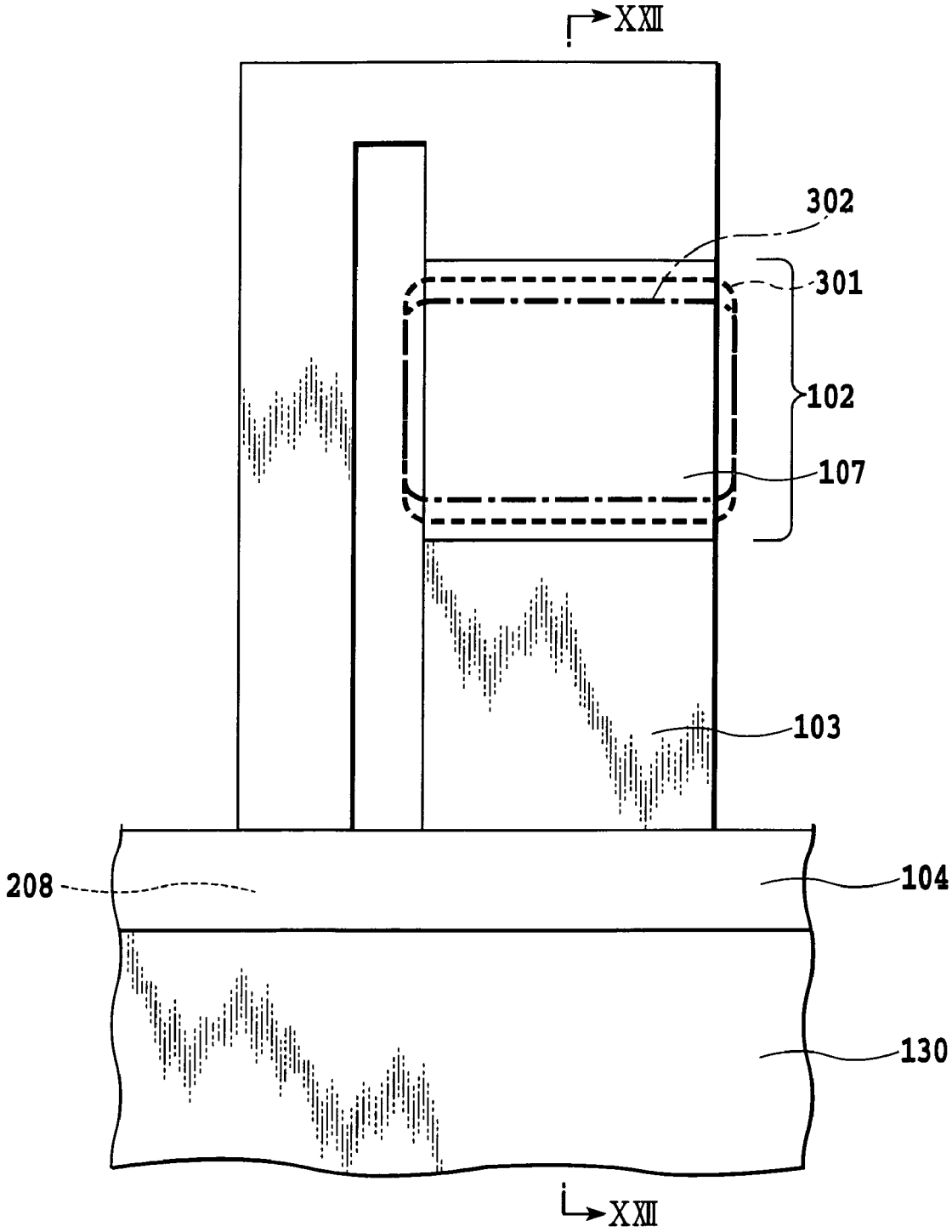
FIG. 21 is a schematic plan view showing a heater in an ink jet head circuit board according to a third embodiment of this invention.
Figure 22:
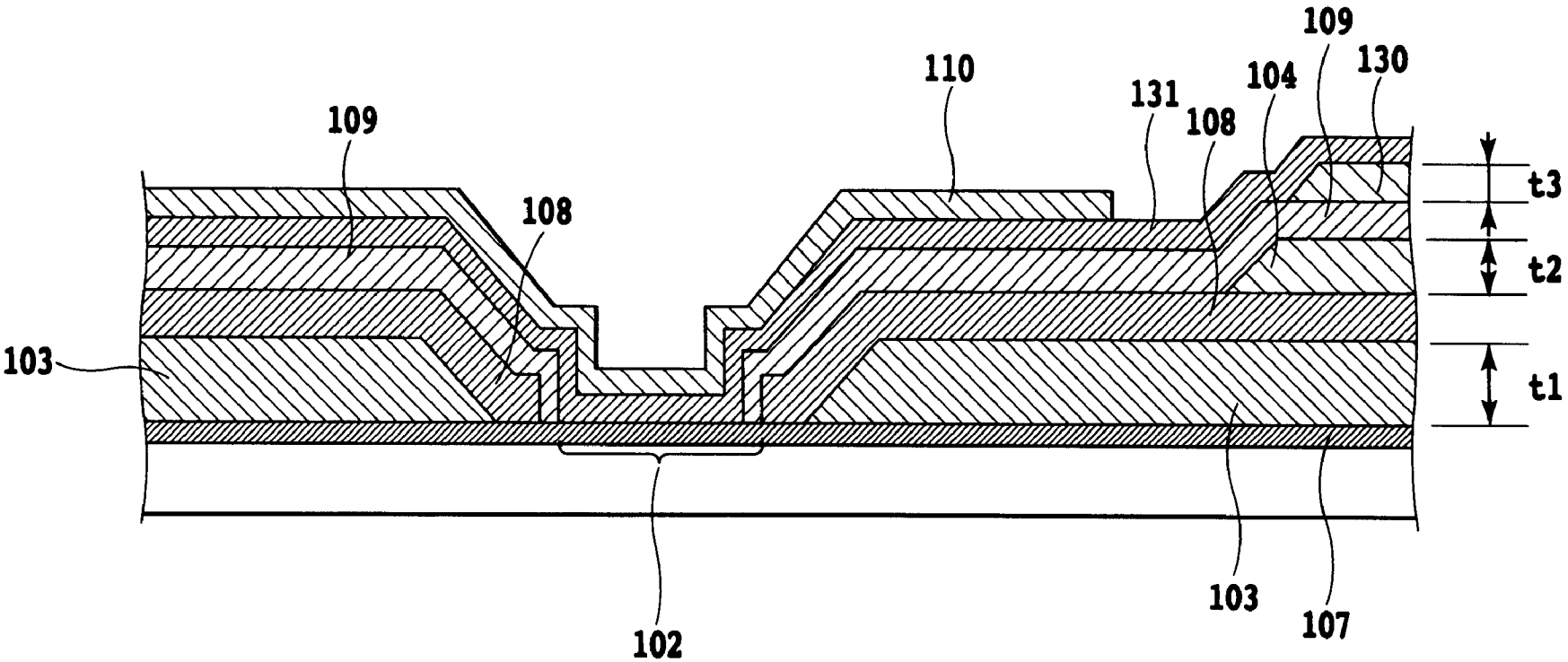
FIG. 22 is a cross-sectional view taken along the line XXII-XXII of FIG. 21.
Figure 23:
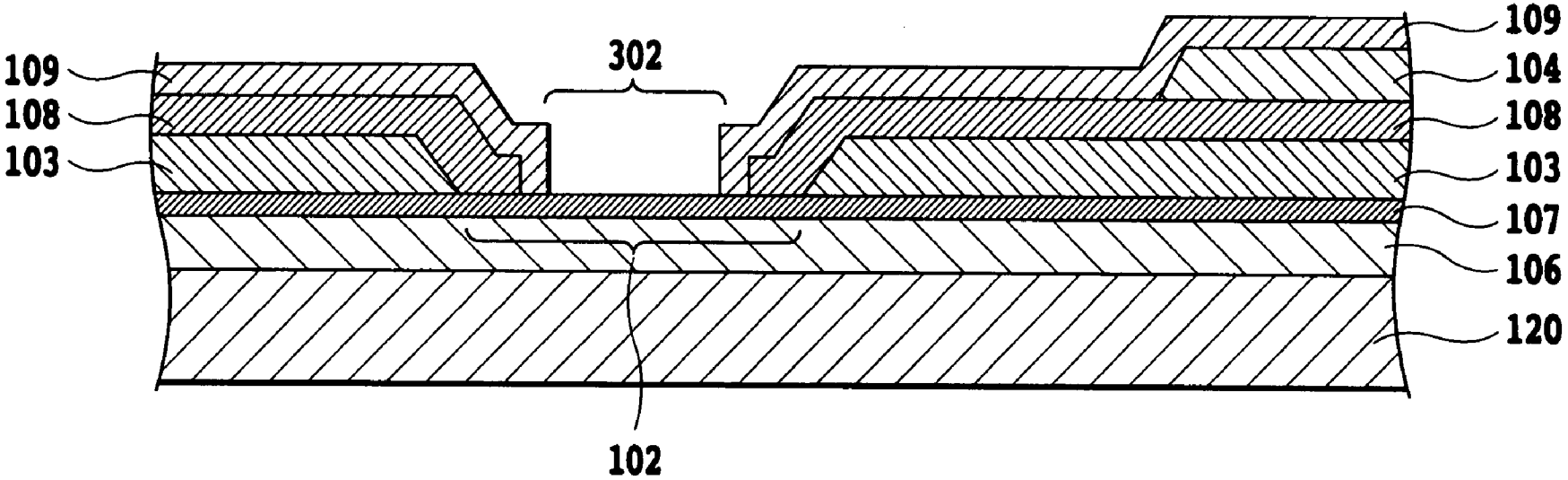
FIG. 23 to FIG. 26 are schematic cross-sectional views showing a process of fabricating the circuit boards shown in FIG. 21 and FIG. 22.

FIG. 21 and FIG. 22 are a schematic plan view showing a heater in the ink jet head circuit board according to the third embodiment of this invention and a schematic cross-sectional view taken along the line XXII-XXII of FIG. 21, respectively. In these figures, components that function in the same way as those of the conventional construction and the first and second embodiment are given like reference numbers.

In the construction of this embodiment, the first electrode wire layer 103, the second electrode wire layer 104 and a third electrode wire layer 130 have a thickness relation of t1, t2>t3, where t1, t2 and t3 are the thicknesses of the first, second and third electrode wire layer, respectively. As stipulated by this invention, after the first protective insulation layer 108 is formed, it is removed from portions 301 above the heater 102. Similarly, after the second protective insulation layer 109 is formed, it is also removed from portions 302 above the heater 102.

Referring to FIG. 23 through FIG. 26, an example process of manufacturing the ink jet head circuit board shown in FIG. 21 and FIG. 22 will be explained.

In the process similar to the one shown in FIG. 6 to FIG. 9 of the first embodiment, the substrate 120 is deposited successively with a heat accumulating layer 106, a resistor layer 107 and a first electrode wire layer 103. After a desired planar shape is obtained, the first electrode wire layer 103 is partially removed to expose the resistor layer 107 thereby forming the heater 102. Then a first protective insulation layer 108 is formed. In this embodiment, the resistor layer 107 is formed to a thickness of about 50 nm and the first electrode wire layer 103 to a thickness of about 600 nm (t1). The first protective insulation layer 108 is formed of a SiO layer about 600 nm thick.

Also in the process similar to the one shown in FIG. 17 to FIG. 19 of the second embodiment, with the resistor layer 107 used as an etch stopper, the SiO layer of the first protective insulation layer 108 is etched away from above the heater 102 (at 301 in FIG. 21). The SiO layer is also etched away to form a through-hole. Then, the second electrode wire layer 104 and the second protective insulation layer 109 are successively deposited. In this embodiment, the first electrode wire layer 103 is formed to a thickness of about 350 nm (t2) and the first protective insulation layer 108 is formed of a SiO layer about 500 nm thick.

Next, with the resistor layer 107 as an etch stopper, the second protective insulation layer 109 is removed from above the heater 102 (at 302 in FIG. 21). At the same time, a through hole is formed for interconnection between the second electrode wire layer 104 and the third electrode wire layer 130 to be formed next, as required.

Figure 24:
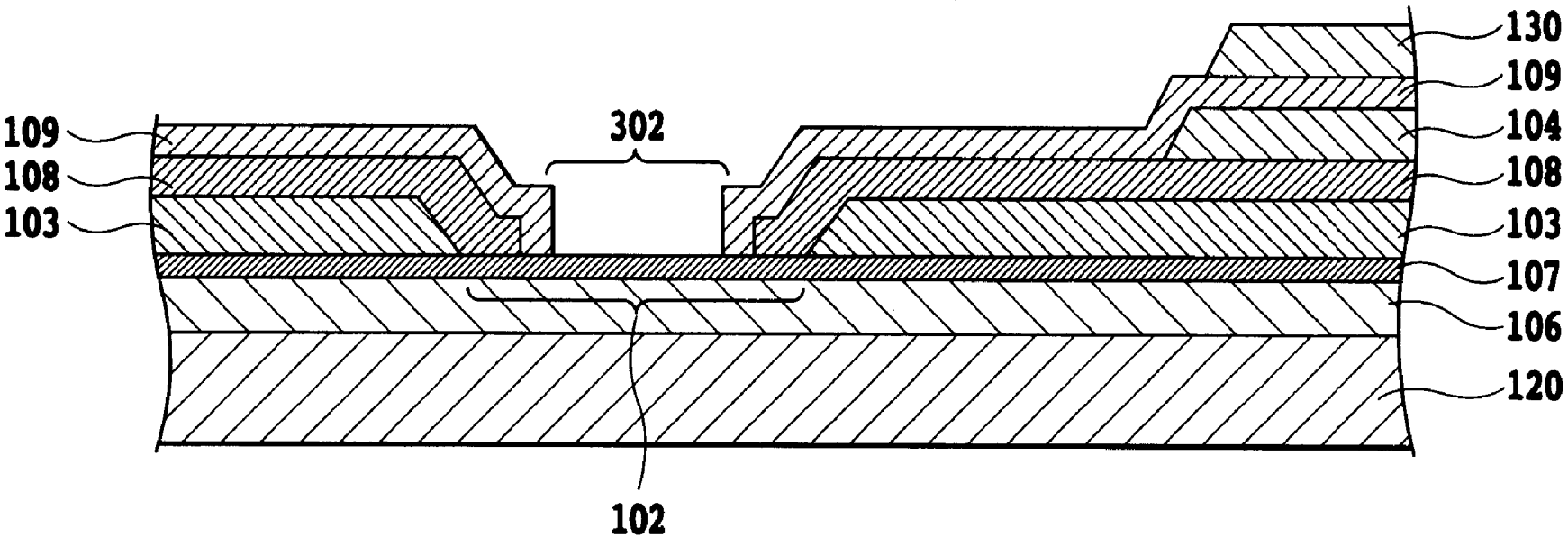

Next, as shown in FIG. 24, an Al layer of the third electrode wire layer 130 is formed by sputtering to a thickness of about 200 nm (t3<t1, t2) and etched into a desired shape by photolithography using wet etching. A part of the third electrode wire layer 130 is connected to the second electrode wire layer 104 via a through-hole not shown.

Figure 25:
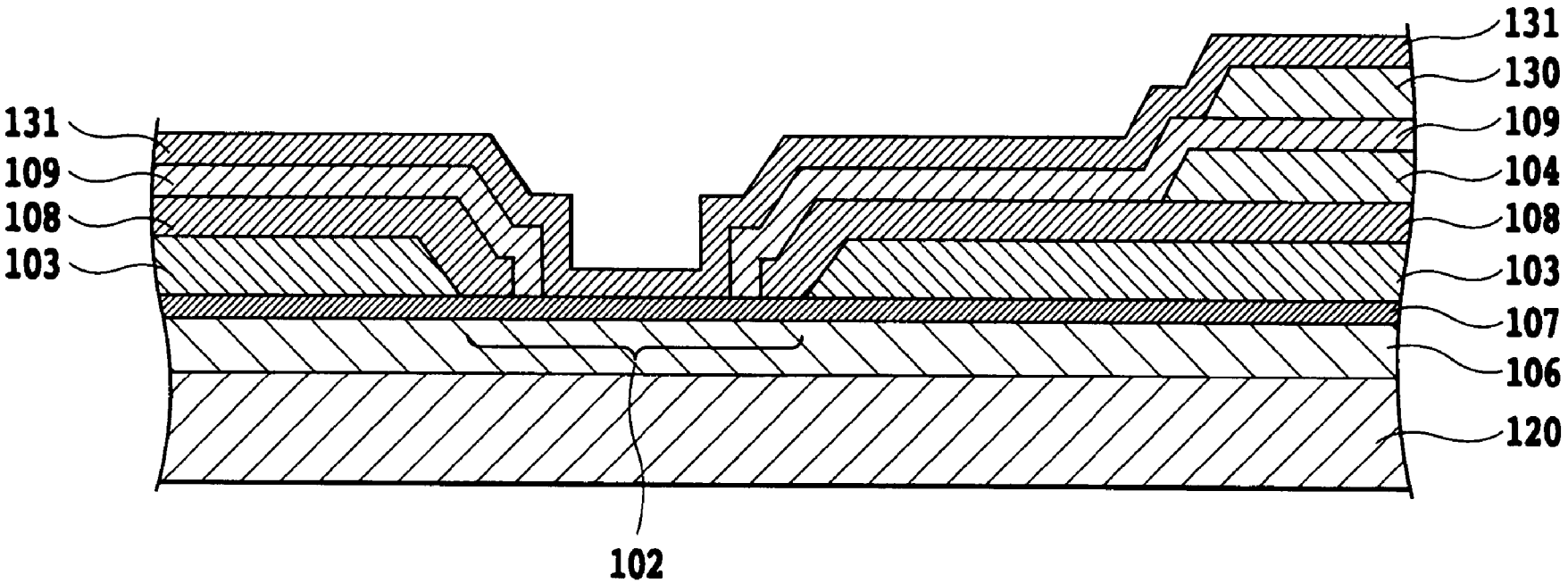

As shown in FIG. 25, a SiN layer as a third protective insulation layer 131 is formed to a thickness of about 300 nm by the plasma CVD. The thickness of the SiN layer is such as will fully cover the third electrode wire layer 130 and will not degrade the thermal conductivity.

Figure 26:
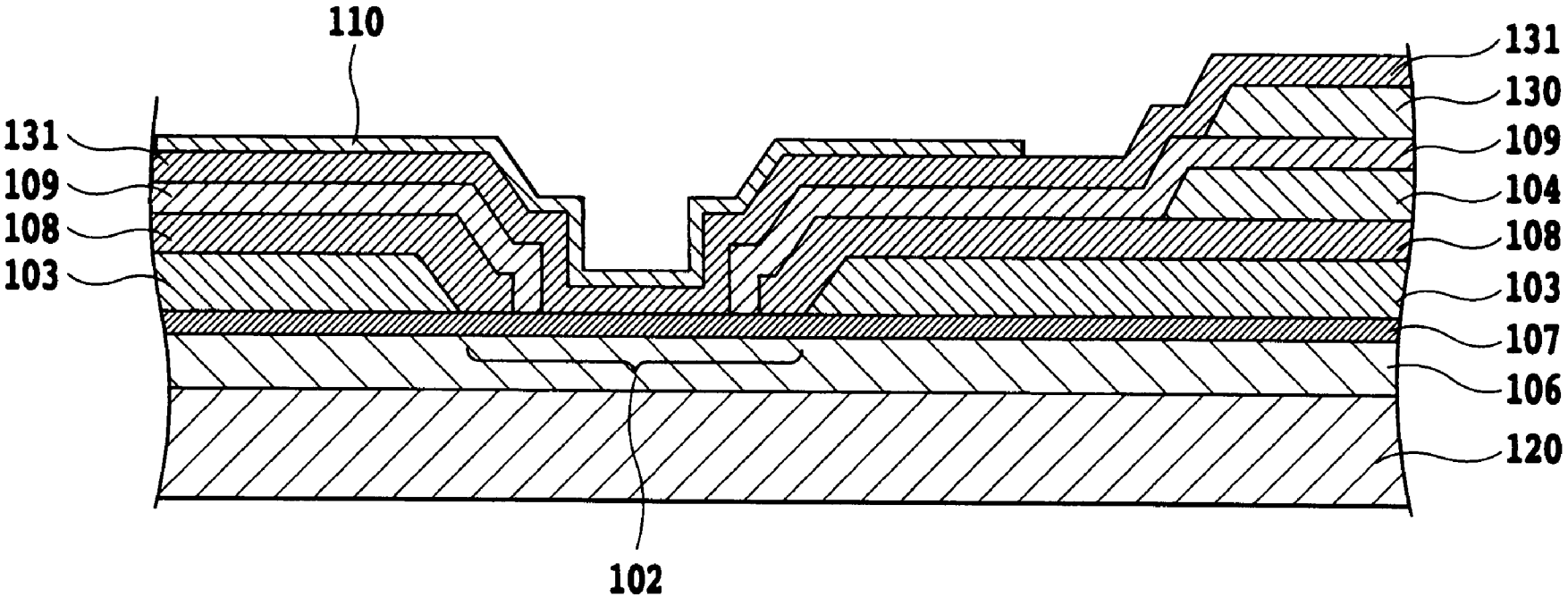

Then, as shown in FIG. 26, a Ta layer 110 as an anticavitation and ink resistant layer is formed by sputtering to a thickness of about 230 nm and etched into a desired shape by photolithography using dry etching.

With the above process, the ink jet head circuit board is completed.

As with the first embodiment, the above process of the third embodiment can also reduce the effective thickness of the protective insulation layer over the heater 102, preventing a degradation of thermal efficiency and substantially reducing the area that the wire pattern for one heater occupies on the substrate.

The thickness relation among the first, second and third electrode wire layer is appropriately determined based on design conditions concerning a reduction in an overall wire resistance for one heater and a reduction in resistance variations among different heaters. In the case of this embodiment, the first electrode wire layer 103 and the second electrode wire layer 104 are made thicker than the third electrode wire layer 130. Therefore, the first protective insulation layer 108 and the second protective insulation layer 109 are partially holed (removed).

While in this embodiment the resistor layer is used as an etch stopper, the etch stopper may be chosen appropriately according to the protective insulation layer to be etched away and to the thicknesses of the first to third electrode wire. That is, depending on the design conditions, the first electrode wire layer 103 and the third electrode wire layer 130 may be thicker than the second electrode wire layer 104. In such a case, the following process may be executed. The process involves partially holing the first protective insulation layer 108 with the resistor layer used as an etch stopper; after the second electrode wire layer 104 and the second protective insulation layer 109 are formed, forming the Ta layer 110 as an anticavitation and ink resistant layer over the second protective insulation layer 109 over which the third electrode wire layer 130 is formed; and forming the third protective insulation layer 131 and then partially holing the third protective insulation layer 131 with the Ta layer 110 as an etch stopper.

Example Construction of Ink Jet Head

Now, an ink jet head using the circuit board of one of the above embodiments will be explained.

Figure 27:
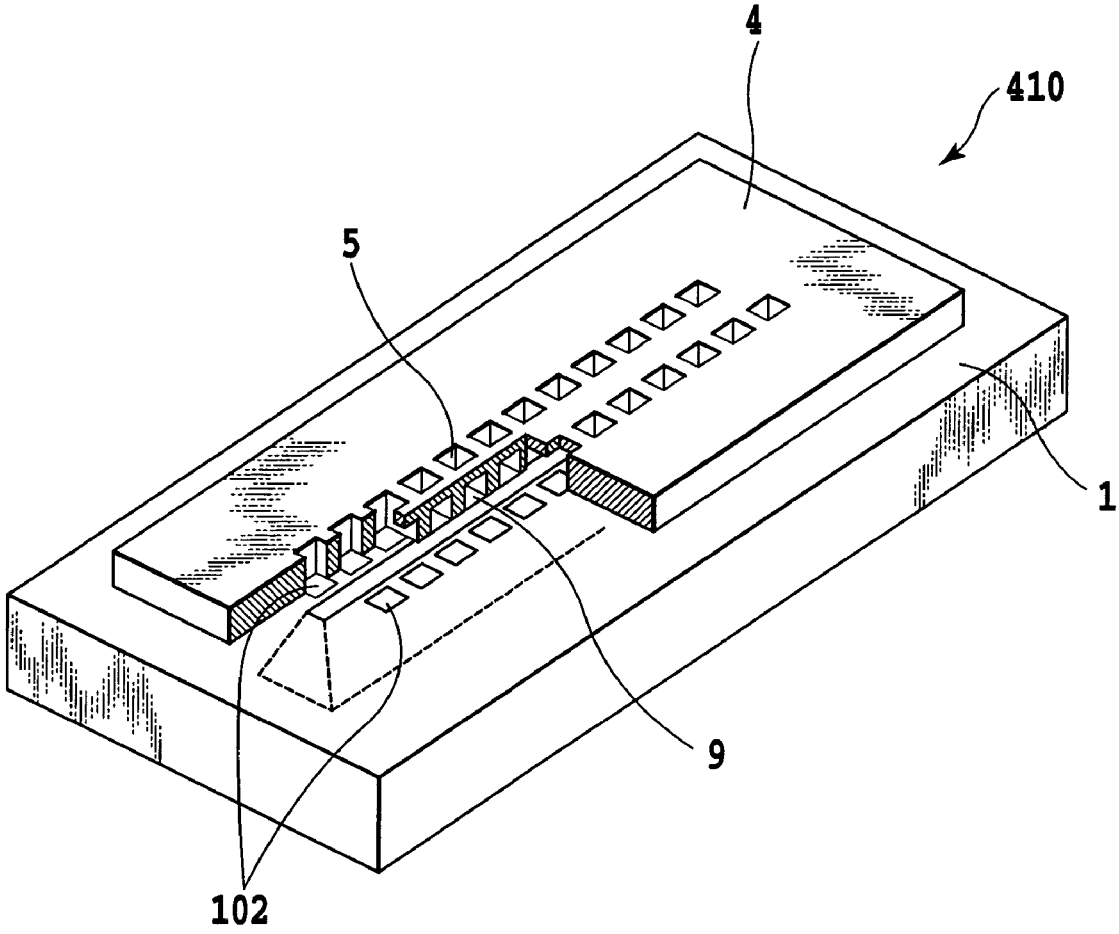
FIG. 27 is a perspective view showing an example ink jet head constructed of the circuit board of one of the first to third embodiments.

FIG. 27 is a schematic perspective view of an ink jet head.

This ink jet head has a circuit board 1 incorporating two parallel columns of heaters 102 arrayed at a predetermined pitch. Here, two circuit boards manufactured by the above process may be combined so that their edge portions where the heaters 102 are arrayed are opposed to each other, thus forming the two parallel columns of heaters 102. Or the above manufacturing process may be performed on a single circuit board to form two parallel columns of heaters in the board.

The circuit board 1 is joined with an orifice plate 4 to form an ink jet head 410. The orifice plate has formed therein ink ejection openings or nozzles 5 corresponding to the heaters 102, a liquid chamber (not shown) to store ink introduced from outside, ink supply ports 9 matched one-to-one to the nozzles 5 to supply ink from the liquid chamber to the nozzles, and a path communicating with the nozzles 5 and the supply ports 9.

Although FIG. 27 shows the two columns of heaters 102 and associated ink ejection nozzles 5 arranged line-symmetrical, they may be staggered by half-pitch to increase the print resolution.

(Ink Jet Head Cartridge and Printing Apparatus)

This ink jet head can be mounted not only on such office equipment as printers, copying machines, facsimiles with a communication system and word processors with a printer unit but also on industrial recording apparatus used in combination with a variety of processing devices. The use of this ink jet head enables printing on a variety of print media, including paper, thread, fiber, cloth, leather, metal, plastic, glass, wood and ceramics. In this specification, a word "print" signifies committing to print media not only significant images such as characters and figures but also nonsignificant images such as patterns.

In the following, a cartridge comprising the above ink jet head combined with an ink tank and an ink jet printing apparatus using this unit will be explained.

Figure 28:
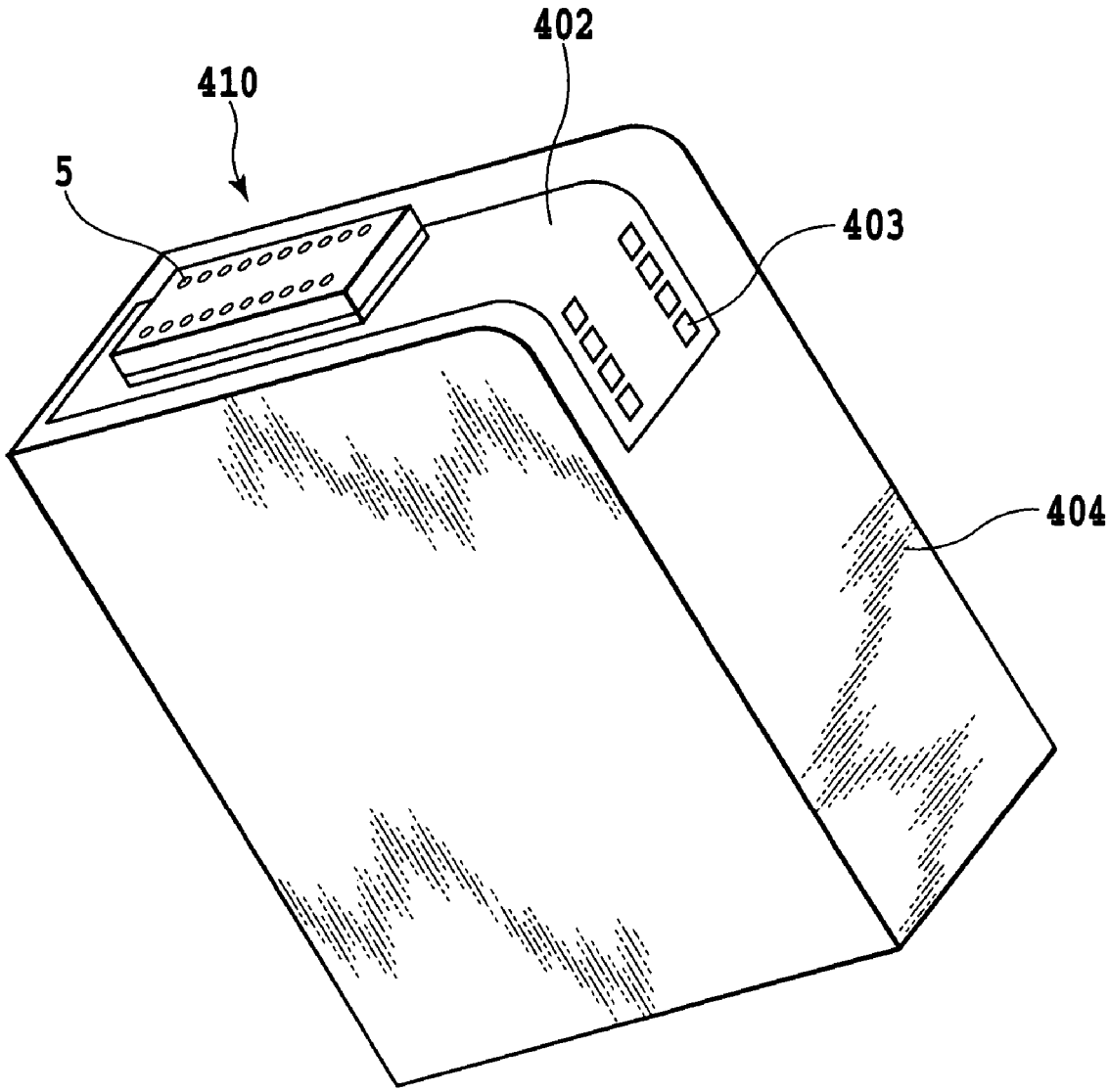
FIG. 28 is a perspective view showing an ink jet cartridge using the ink jet head of FIG. 27.

FIG. 28 shows an example construction of an ink jet head unit of cartridge type incorporating the above ink jet head as its constitutional element. In the figure, denoted 402 is a TAB (tape automated bonding) tape member having terminals to supply electricity to the ink jet head 410. The TAB tape member 402 supplies electric power from the printer body through contacts 403. Designated 404 is an ink tank to supply ink to the head 410. The ink jet head unit of FIG. 28 has a cartridge form and thus can easily be mounted on the printing apparatus.

Figure 29:
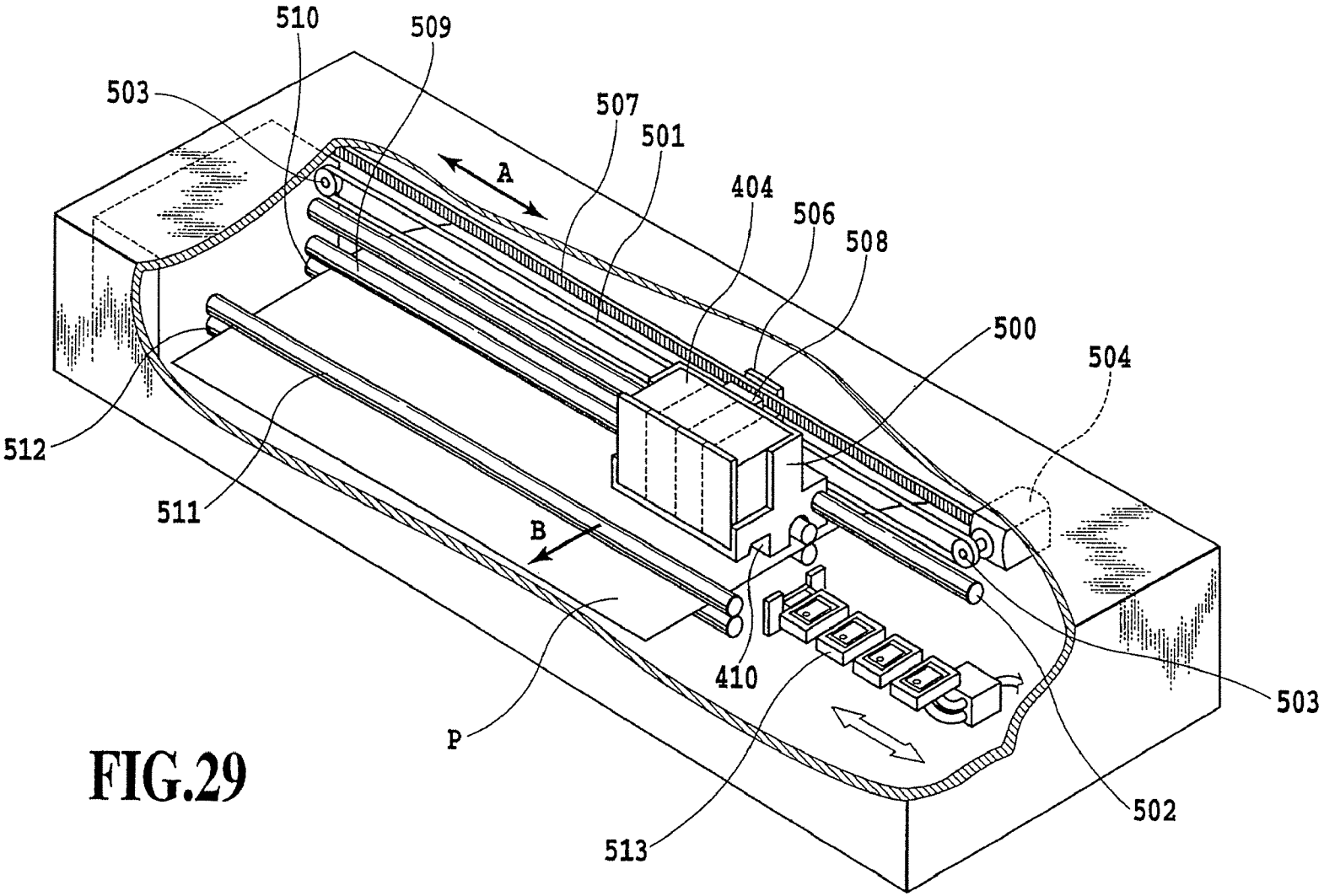
FIG. 29 is a schematic perspective view showing an example construction of an ink jet printing apparatus using the ink jet cartridge of FIG. 28.

FIG. 29 schematically shows an example construction of an ink jet printing apparatus using the ink jet head unit of FIG. 28.

In the ink jet printing apparatus shown, a carriage 500 is secured to an endless belt 501 and is movable along a guide shaft 502. The endless belt 501 is wound around pulleys 503, 503 one of which is coupled to a drive shaft of a carriage drive motor 504. Thus, as the motor 504 rotates, the carriage 500 is reciprocated along the guide shaft 502 in a main scan direction (indicated by arrow A).

The ink jet head unit of a cartridge type is mounted on the carriage 500 in such a manner that the ink ejection nozzles 5 of the head 410 oppose paper P as a print medium and that the direction of the nozzle column agrees with other than the main scan direction (e.g., a subscan direction in which the paper P is fed). A combination of the ink jet head 410 and an ink tank 404 can be provided in numbers that match the number of ink colors used. In the example shown, four combinations are provided to match four colors (e.g., black, yellow, magenta and cyan).

Further, in the apparatus shown there is provided a linear encoder 506 to detect an instantaneous position of the carriage in the main scan direction. One of two constitutional elements of the linear encoder 506 is a linear scale 507 which extends in the direction in which the carriage 500 moves. The linear scale 507 has slits formed at predetermined, equal intervals. The other constitutional element of the linear encoder 506 includes a slit detection system 508 having a light emitter and a light sensor, and a signal processing circuit, both provided on the carriage 500. Thus, as the carriage 500 moves, the linear encoder 506 outputs a signal for defining an ink ejection timing and carriage position information.

The paper P as a print medium is intermittently fed in a direction of arrow B perpendicular to the scan direction of the carriage 500. The paper is supported by a pair of roller units 509, 510 on an upstream side of the paper feed direction and a pair of roller units 511, 512 on a downstream side so as to apply a constant tension to the paper to form a planar surface for the ink jet head 410 as it is transported. The drive force for the roller units is provided by a paper transport motor not shown.

In the above construction, the entire paper is printed by repetitively alternating the printing operation of the ink jet head 410 as the carriage 500 scans and the paper feed operation, each printing operation covering a band of area whose width or height corresponds to a length of the nozzle column in the head.

The carriage 500 stops at a home position at the start of a printing operation and, if so required, during the printing operation. At this home position, a capping member 513 is provided which caps a face of each ink jet head 410 formed with the nozzles (nozzle face). The capping member 513 is connected with a suction-based recovery means (not shown) which forcibly sucks out ink from the nozzles to prevent nozzle clogging.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2004-236604 filed Aug. 16, 2004, which is hereby incorporated by reference herein.

What is claimed is:

1. An ink jet head circuit board comprising:

a board;

a resistor layer formed on the board;

a pair of first electrode layers disposed on the resistor layer with a gap so as to be opposed to each other, the resistor layer forming a heater at a portion corresponding to the gap so as not to be covered with the first electrode layers;

a first protective layer entirely covering the portion of the resistor layer corresponding to the gap and covering the pair of the first electrode layers;

a second electrode layer formed on the first protective layer except at least over the gap and electrically connected to at least one of the pair of first electrode layers, the second electrode layer being greater in thickness than an edge of the first electrode layers facing the gap;

a second protective layer formed on the second electrode layer to cover the first protective layer except at least a portion of the first protective layer corresponding to the gap, the second protective layer being greater in thickness than the first protective layer, wherein the first protective layer is formed as a single continuous layer.

2. An ink jet head circuit board as claimed in claim 1, wherein a further protective layer is formed on the first protective layer including the gap to protect the first protective layer against impacts caused by ink cavitation.

3. An ink jet head comprising:

an ink jet head circuit board as claimed in claim 1; and an ink ejection nozzle corresponding to the heater.

* * * * *